US008695346B1

(12) United States Patent
Pickette

(10) Patent No.: US 8,695,346 B1
(45) Date of Patent: Apr. 15, 2014

(54) CERAMIC BASED ENHANCEMENTS TO FLUID CONNECTED HEAT TO MOTION CONVERTER (FCHTMC) SERIES ENGINES, CALORIC ENERGY MANAGER (CEM), PORCUPINE HEAT EXCHANGER (PHE) CERAMIC-FERRITE COMPONENTS (CERFITES)

(76) Inventor: Wayne Pickette, Champaign, IL (US)

( * ) Notice: Subject to any disclaimer, the term of this patent is extended or adjusted under 35 U.S.C. 154(b) by 26 days.

(21) Appl. No.: 13/087,138

(22) Filed: Apr. 14, 2011

Related U.S. Application Data

(63) Continuation-in-part of application No. 11/561,393, filed on Dec. 10, 2006, now Pat. No. 7,980,080.

(51) Int. Cl.
*F01K 25/08* (2006.01)
*F01K 25/00* (2006.01)

(52) U.S. Cl.
USPC ..... 60/651; 60/671

(58) Field of Classification Search
USPC ..... 60/516–526, 645, 651, 670, 671
See application file for complete search history.

(56) References Cited

U.S. PATENT DOCUMENTS 3,739,573 A * 6/1973 Giner ..... 60/671
4,901,787 A * 2/1990 Zornes ..... 165/4
5,711,988 A * 1/1998 Tsai et al. ..... 427/80
6,701,708 B2 * 3/2004 Gross et al. ..... 60/517
7,320,218 B2 * 1/2008 Silver et al. ..... 60/517
7,908,856 B2 * 3/2011 Backhaus et al. ..... 60/517
2003/0042007 A1 * 3/2003 Sandu et al. ..... 165/94

OTHER PUBLICATIONS

Create the future contest 2010 Procupine Heat Exchanger USA, WP.

* cited by examiner

*Primary Examiner* — Thomas Denion
*Assistant Examiner* — Laert Dounis

(57) ABSTRACT

The components in this application utilize advanced ceramics, which are homogeneous rather than crystalline. This feature allows strong, fine detail parts of great definition, that remain stable and have extraordinary wear resistant characteristics. The Porcupine Pin is a solid-bodied extrusion from a surface through a surface or tangent to a surface. The homogeneous features give extreme durability and equalized flow characteristics. The porcupine pin may be created in other shapes, where within it is embedded ferrite material to form a part that is an electromagnet sensitive or magnetically stable, while exhibiting excellent sliding ability and a precision of detail. These features also allow exceptional miniaturization of magnetically active parts called a Cerfite.

3 Claims, 37 Drawing Sheets

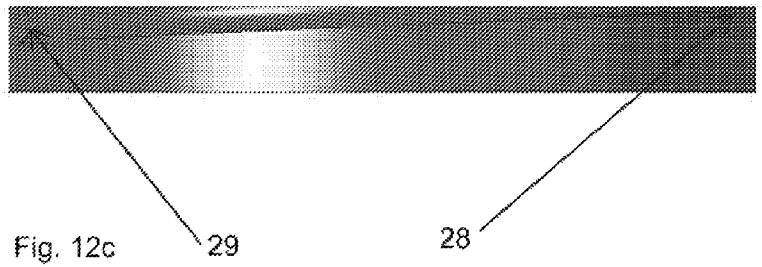
Fig. 12c
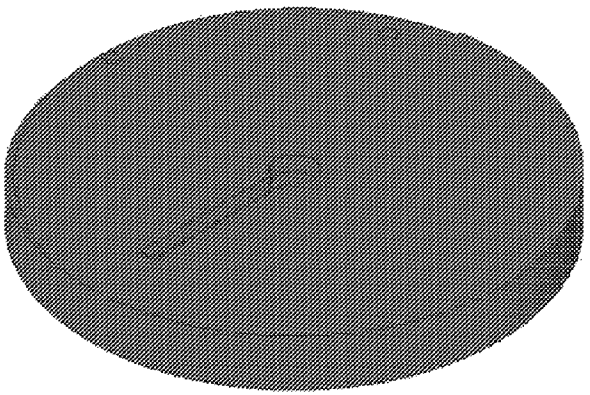
Fig. 12
Fig 12a
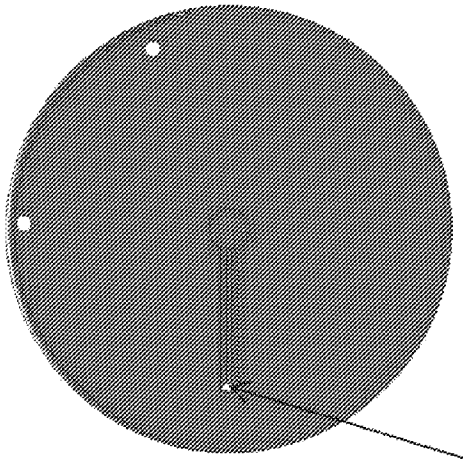
Fig. 12b
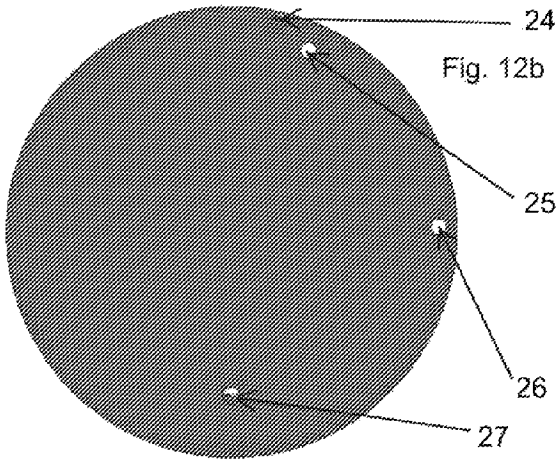

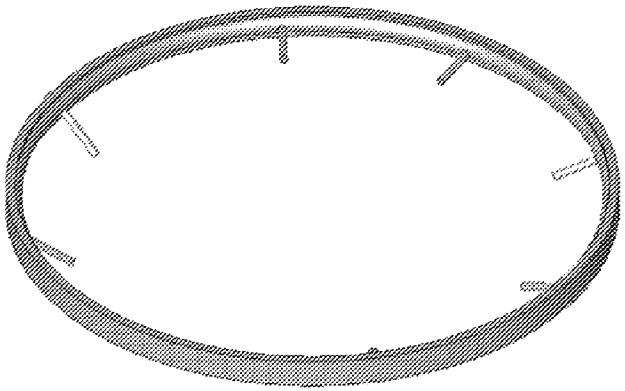
Fig. 22
Fig. 22a
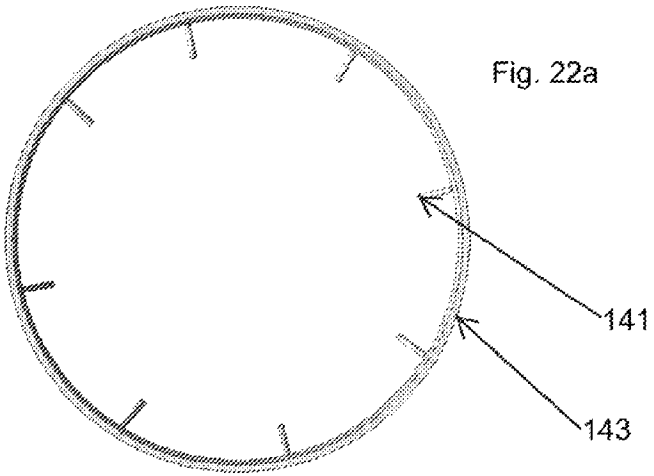
Fig. 22b
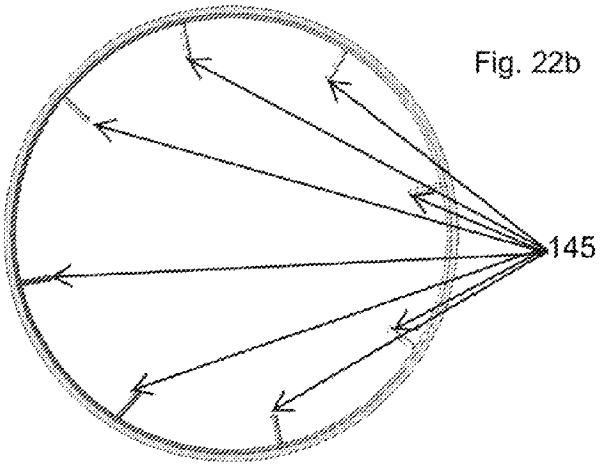

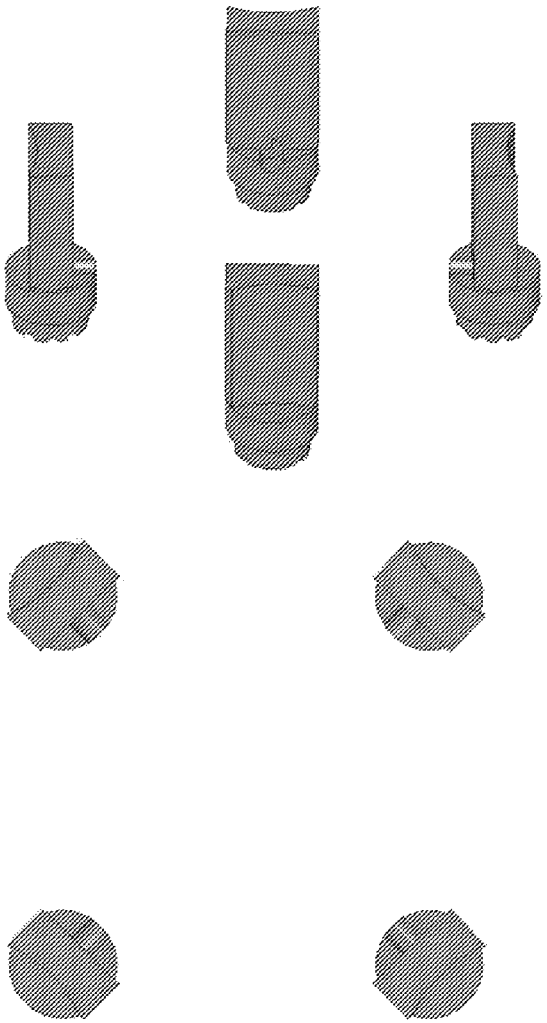
Fig. 25b
Fig. 25
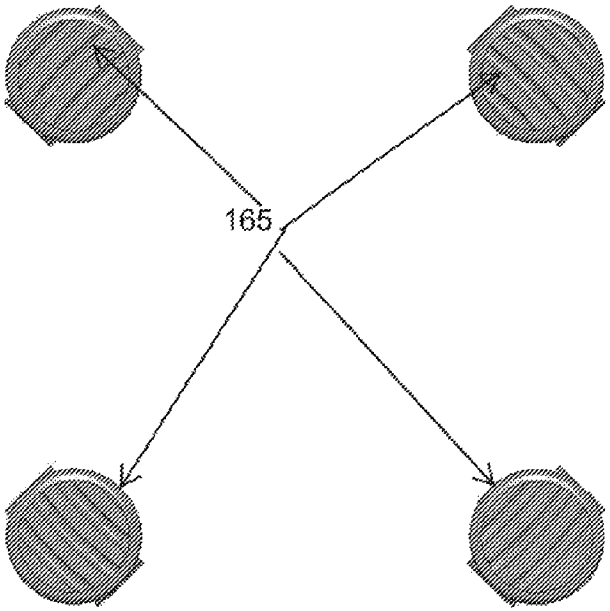
Fig. 25a

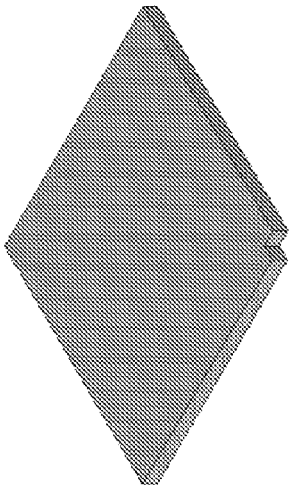
Fig. 26
Fig. 26a
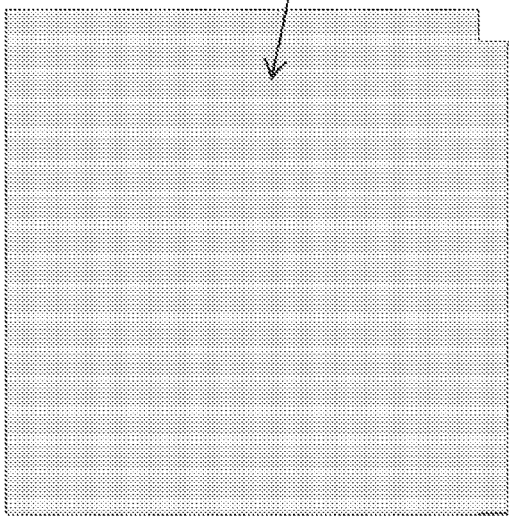
Fig. 26b
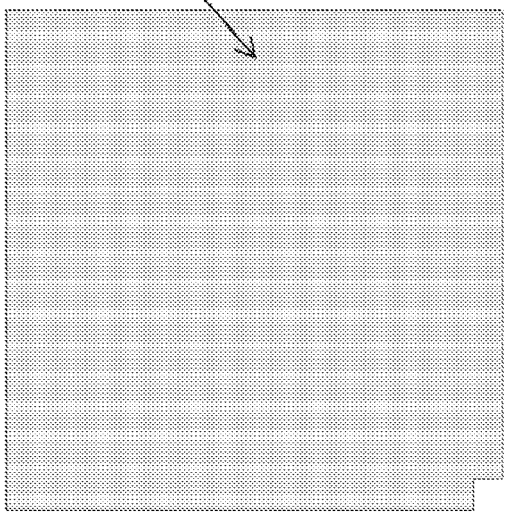

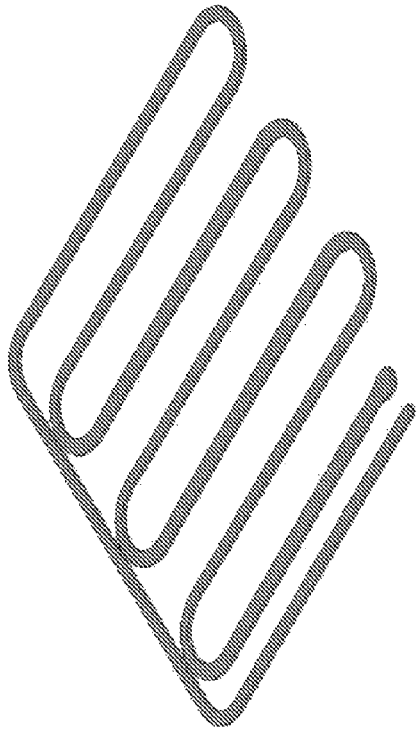
Fig. 27
Fig. 27a
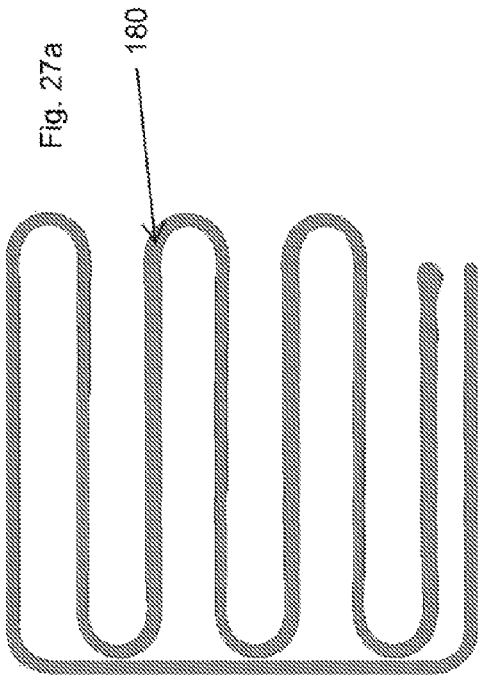
Fig. 27b
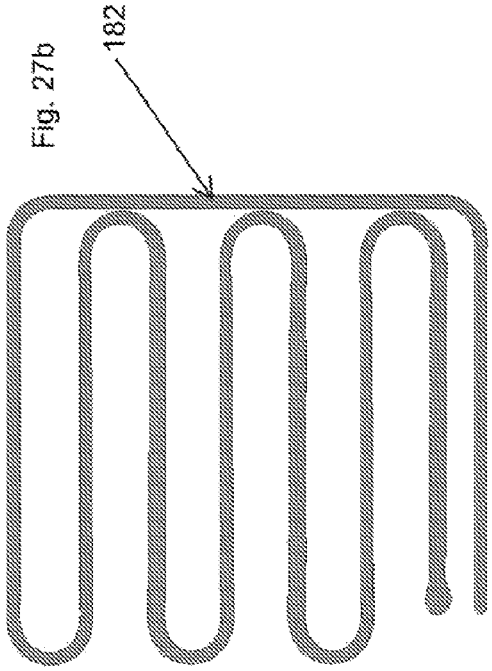

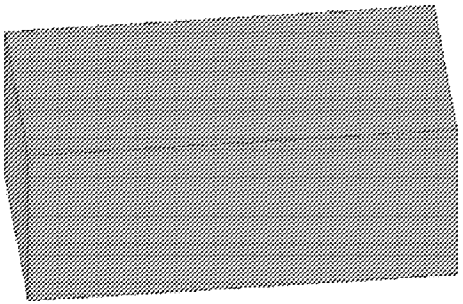
Fig. 32
Fig. 32a
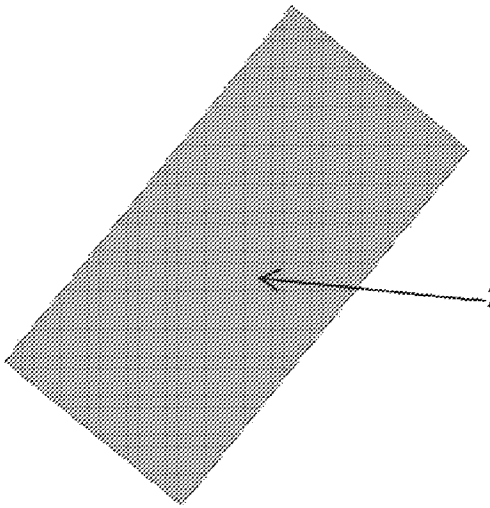
Fig. 32b
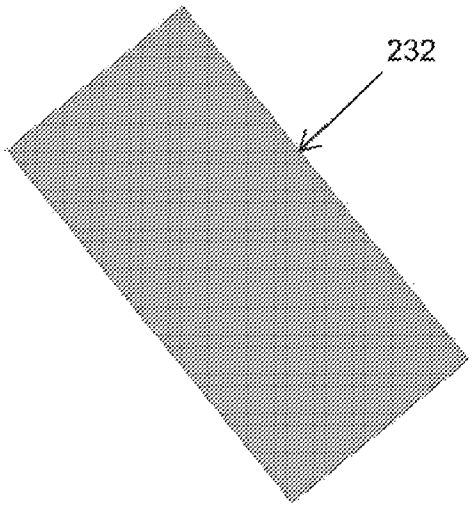

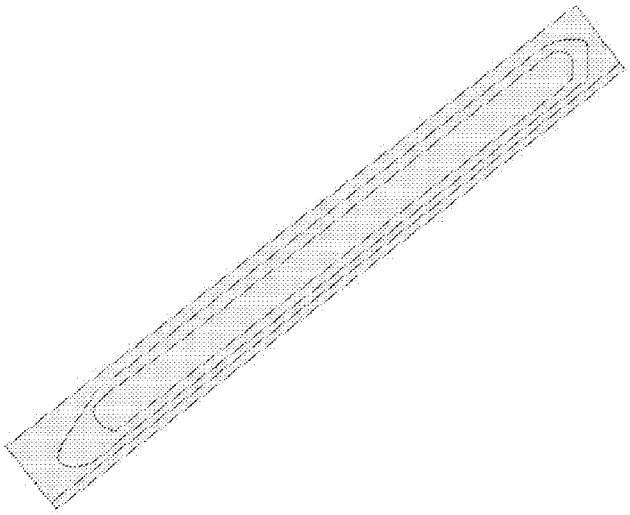
Fig. 34
Fig. 34a
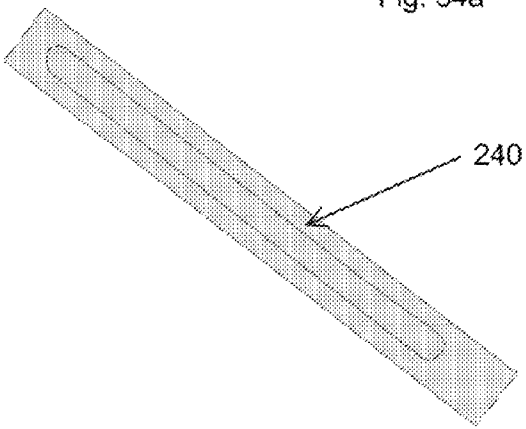
Fig. 34b
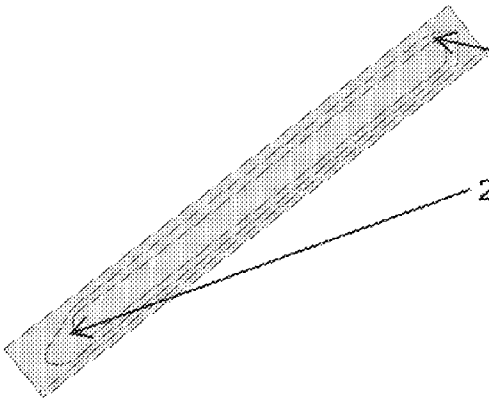

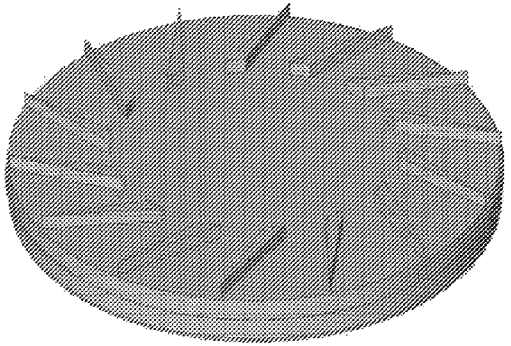
Fig. 36
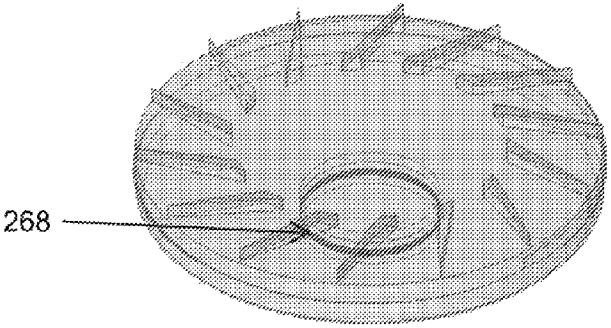
Fig. 36c
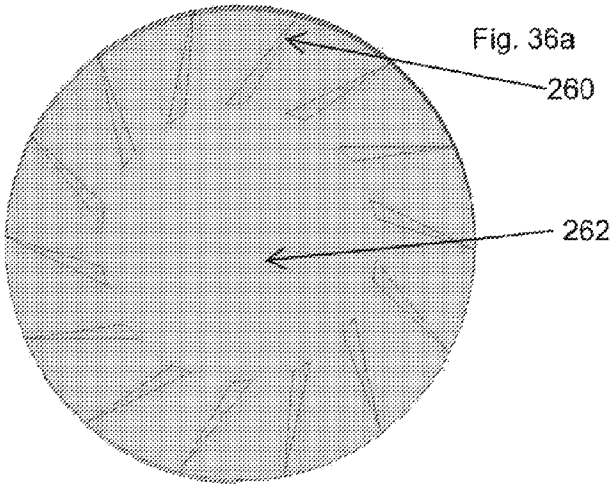
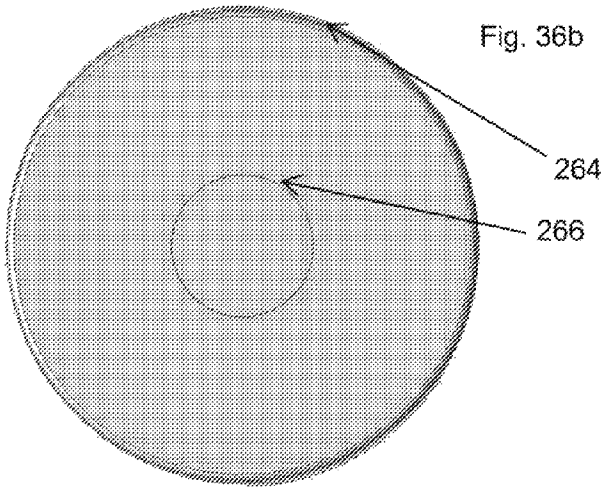

CERAMIC BASED ENHANCEMENTS TO FLUID CONNECTED HEAT TO MOTION CONVERTER (FCHTMC) SERIES ENGINES, CALORIC ENERGY MANAGER (CEM), PORCUPINE HEAT EXCHANGER (PHE) CERAMIC-FERRITE COMPONENTS (CERFITES)

CROSS REFERENCE TO RELATED APPLICATIONS

This is a continuation in part of application Ser. No. 11/561,393, Filed Dec. 10, 2006, now U.S. Pat. No. 7,980,080, granted Jul. 12, 2011, within which we include by reference the flat ceramic plates with geometrical cavities designed to hold all components enclosed and pipes within structure construction.

FEDERALLY SPONSORED RESEARCH

None

SEQUENCE LISTING

None

BACKGROUND OF INVENTION

The original patent application 11561393 was filed with the copper Heat-Anvil, performing the import and temporary holding of caloric energy. After the application was filed the inventors became aware of new developments in ceramics that afforded heat exchangers to be created almost entirely from ceramics. The main inventor Mr. Pickette assumed the task of creating a lighter more robust performing Heat-Anvil equivalent in the form of multiple homogeneous ceramic components contained within a shell outwardly a physical form identical with that of the original Heat Anvil.

The inventor was aware that oil had been utilized in electrical Power Company transformers for years. It seemed logical to embrace this mode of a utility media to manage caloric energy. After another short search, a biologically compatible oil was found. A biological harmonious oil is necessary to avoid toxic environmental contamination in any case of a spill.

The original homogeneous ceramic is a poor conductor of caloric energy, making it ideal for the construction of a device that should not steal energy from the contents it encounters. Further searching found another ceramic that, while not the best conductor of caloric energy, was nearly one-half as conductive as the optimum conductor copper. This ceramic is utilized to construct caloric energy exchanging parts.

Other embodiments of this device may include embedding or other styles of embodiments without departing from the spirit of the device.

SUMMARY

The concept developed to design a universal part of the homogeneous material defined as the Quill. This quill could be constructed of both caloric conducting or caloric conduction resistant ceramic. Hereinafter the quill when combined with ferrite shall be named a Cerfite.

Other effects of the homogeneous ceramic material are its ability to seal securely under slight compression and where necessary, while components are light weight, precisely formed and slide nearly without effort, requiring minuscule, if any, lubrication.

The Cerfite may be constructed of either ceramic material which may be molded into any shape embedding extremely fine detail, ease of sliding, and of the stable dimensionality.

The Cerfite, when filled with soft-ferrite material, becomes a part that responds to magnetic energy, and may be molded in nearly any form necessary.

The Cerfite, when filled with hard-ferrite material, becomes a permanent magnet, which is protected from acids, corrosion, moderate impact, and may be molded into nearly any shape.

In accordance with one embodiment, the above effects combined with the geometrical cavity plates and pipes in structure provide means to compact at reduced manufacturing cost, great complexity and miniaturization, which may also be expounded to larger assemblies without modification. These features then allow for more compact and reliable larger assemblies of the same and other functional orders with the same savings in manufacturing costs. All this shall become apparent by a study of this application.

BRIEF DESCRIPTION OF DRAWINGS

FIGS. 12, 12A, 12B, and 12C illustrate various perspectives of the Plate C.

FIGS. 22, 22A, and 22B illustrate various perspectives of the Caloric Induction Ring.

FIGS. 25, 25A, and 25B illustrate various perspectives of the Caloric Conductor.

FIGS. 26, 26A, and 26B illustrate various perspectives of the Plate S9A.

FIGS. 27, 27A, and 27B illustrate various perspectives of the electric heating element.

FIGS. 28, 28A, and 28B illustrate various perspectives of the Cerfite Ball.

FIGS. 32, 32A, and 32B illustrate various perspectives of the Lock Magnet.

FIGS. 34, 34A, and 34B illustrate various perspectives of the CEM Plate S2 Track.

FIGS. 36, 36A, and 36B illustrate various perspectives of the pump rotor.

DRAWINGS

Figure 1:
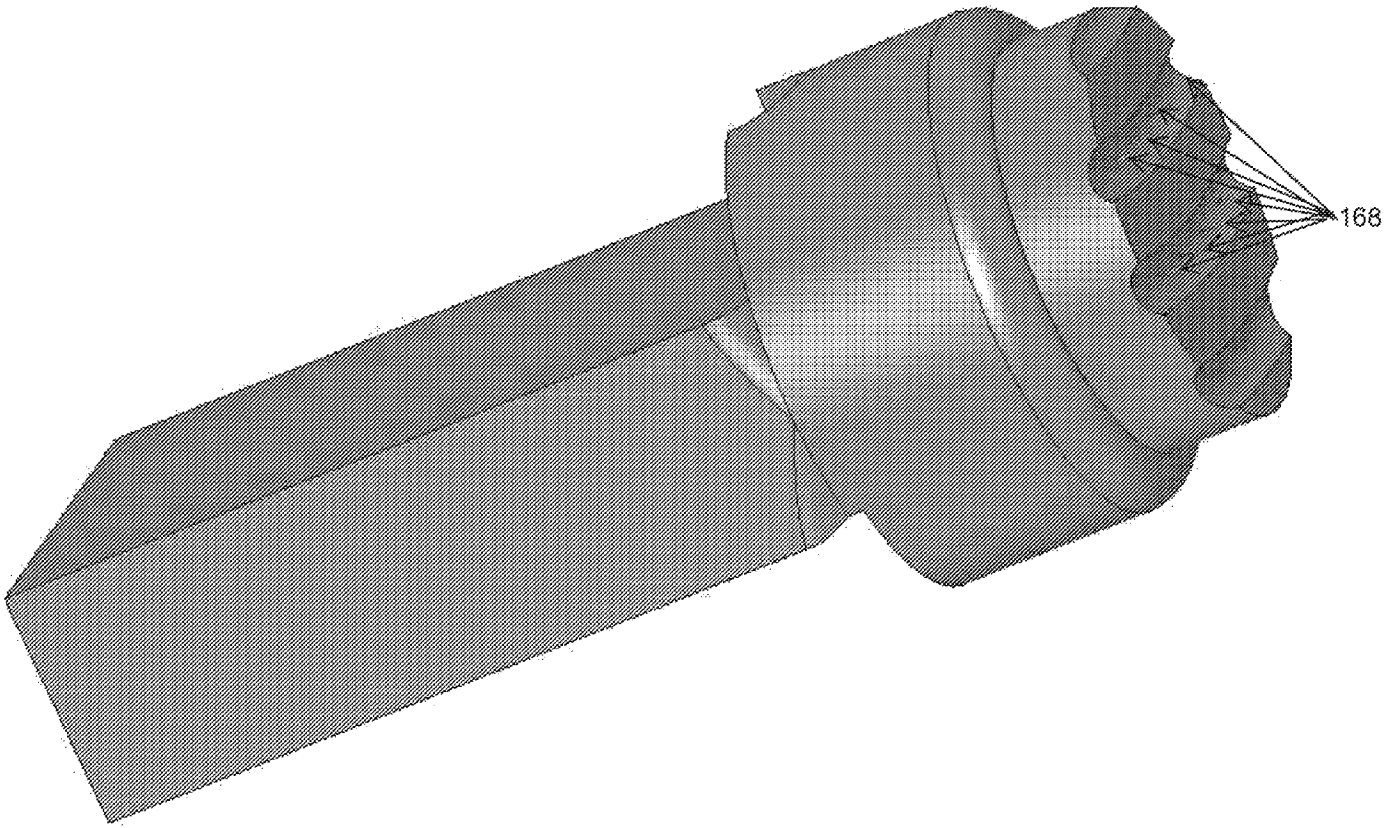
FIG. 1 illustrates a Cerfite hot-spot.

FIG. 1: It illustrates the Cerfite Hot-Spot, which contains on its bottom rounded Cerfite extrusions to aid caloric energy transfer, the entire assembly is constructed of the caloric energy conducting ceramic.

Figure 2:
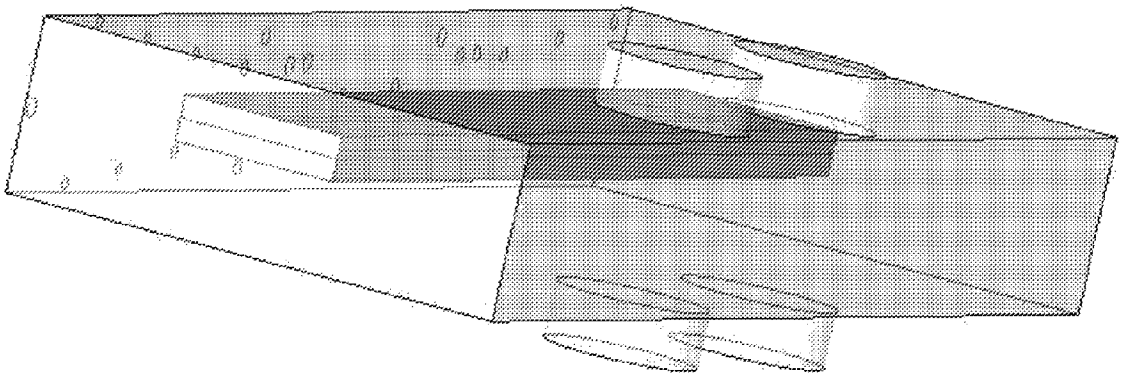
FIG. 2 illustrates a Cerfite shuttle.

FIG. 2: It illustrates the Cerfite Shuttle, which oscillates inside a track, where it drives a gear in stroke then continues around the end of the track to return to the start point for another stroke. The entire part is constructed of non-caloric energy conducting ceramic embedded with soft-ferrite material.

Figure 3:
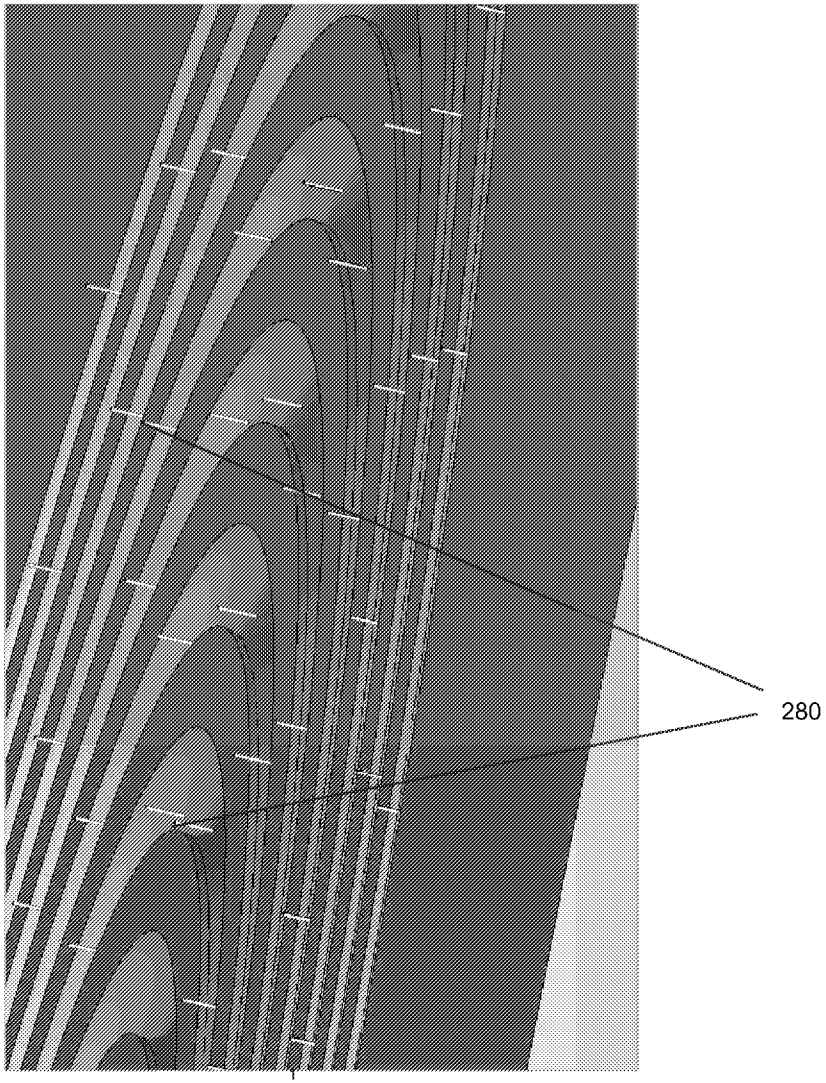
FIG. 3 illustrates a Cerfite heat exchange quill.

FIG. 3: It illustrates the solid round Cerfite Exchange quill constructed in a solid-bodied part, when interspersed on a tube or other type of carrier to form a caloric energy exchange function or likewise function, the part is constructed entirely of caloric energy conducting ceramic.

Figure 4:
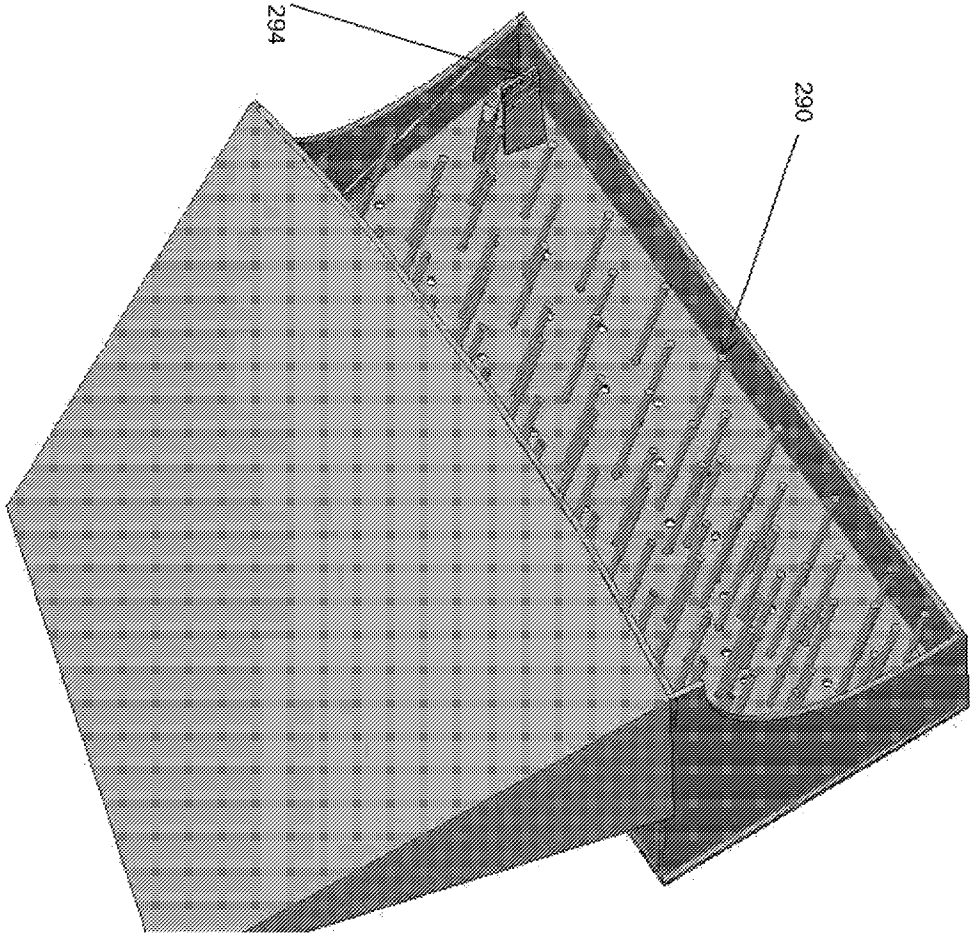
FIG. 4 illustrates one embodiment of the Cerfite quills on a surface.

FIG. 4: It illustrates the solid round Cerfite quill dispersed as an array on a surface to exchange caloric energy from a vapor with a magnetically activated Cerfite flapper fan. The entire body of the caloric energy exchanger is constructed of caloric energy conducting ceramic, while the Cerfite flapper fan is constructed of non-caloric energy conducting ceramic embedded with soft-ferrite material at the top.

Figure 5:
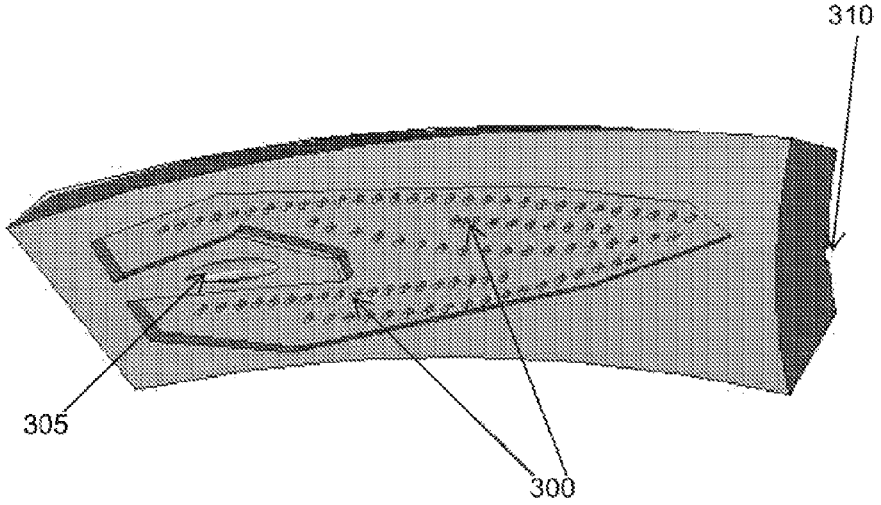
FIG. 5 illustrates an alternate embodiment of the Cerfite quills on a surface.

FIG. 5: It illustrates the solid round Cerfite pin dispersed along a curved surface to aid in exchange of caloric energy, in this case the entire component is constructed of caloric energy conducting ceramic.

Figure 6:
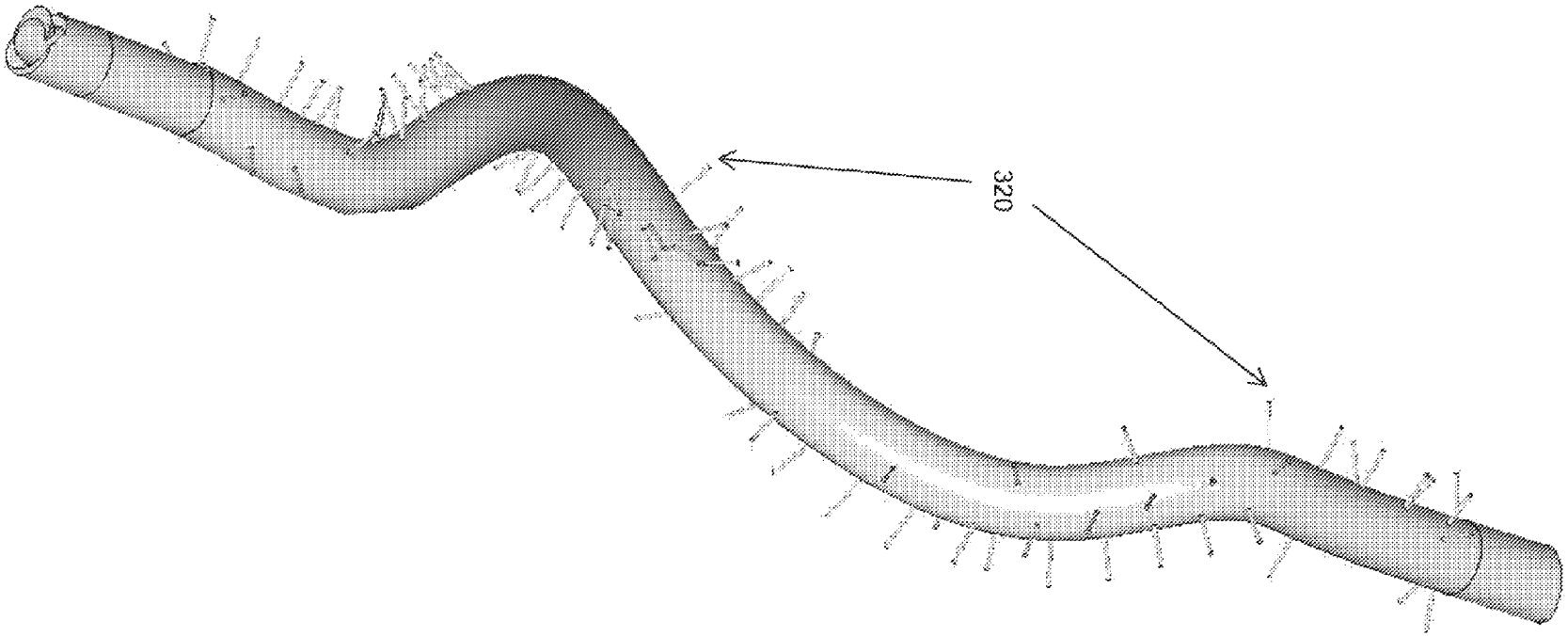
FIG. 6 illustrates Cerfite quills on a tube assembly.

FIG. 6: It illustrates the solid round Cerfite quill dispersed around a sinusoidal exchange tube assembly to enhance the transfer of caloric energy from vapors contained within the outer tube. While the outer tube is constructed of none caloric energy conducting ceramic, the entire inner tube and quill construction is created from caloric energy conducting ceramic.

Figure 7:
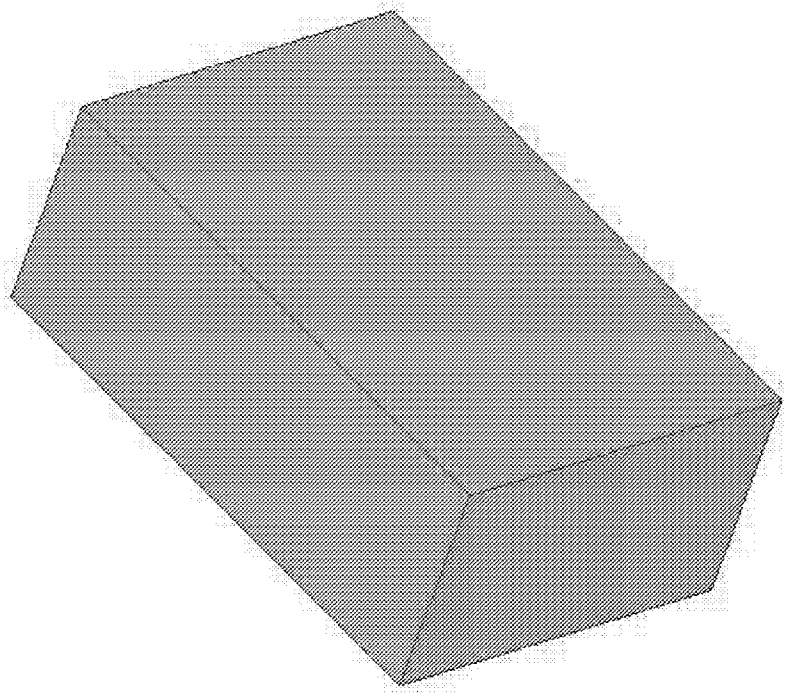
FIG. 7 illustrates bias magnets.

FIG. 7: It illustrates the bias magnets that are formed by combining non-caloric conducting ceramic, enclosing hard-ferrite material to form a permanent magnet that is thermally protected, resistant to acid and alkaline effluents, while being lightweight, precise, stable and may be molded into any shape.

Figure 8:
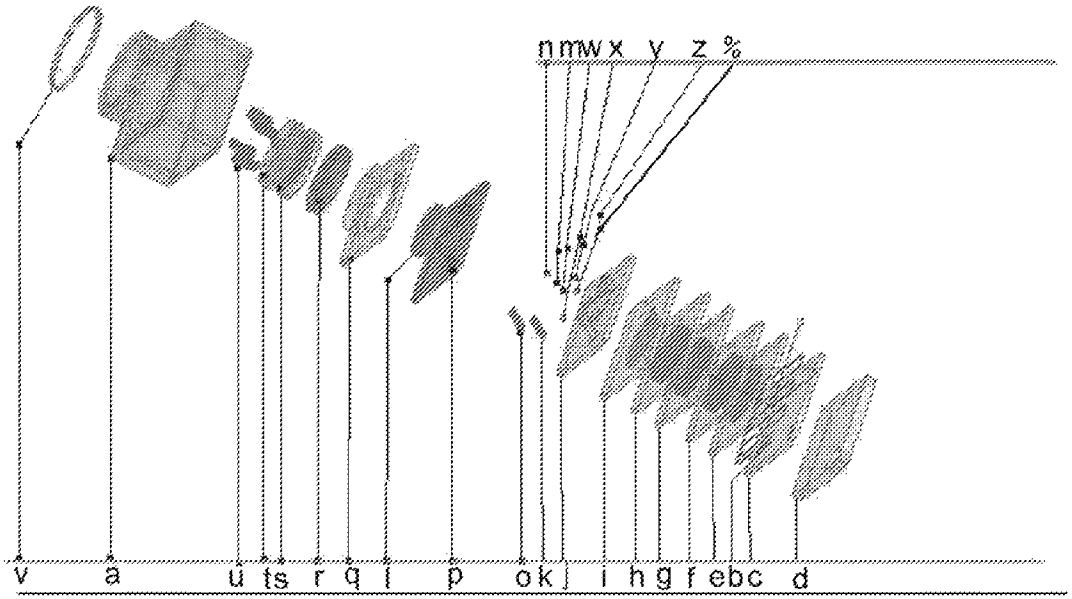
FIG. 8 illustrates an exploded view of the caloric energy manger.

FIG. 8: It illustrates the caloric energy transfer ring that is constructed entirely of caloric energy conduction ceramic.

a Case 1
b Electrical Heating Element 1
c Plate S9A 1
d Plate S9 1
e Plate S8 1
f Plate S7 1
g Plate S6
h Plate S5 1
i Plate S4 1
j Plate S3
k Shuttle lower Guide Plate 1
l Pump Rotor
m Shuttle 1
n Shuttle Ferrite 1
o Shuttle upper Guide Plate 1
p Plate S2 1
q Plate S1 1
r Turret Plate C 1
s Turret Plate D 1
t turret Plate E 1
u Caloric Conductor (hot spot) 4
v Caloric Induction Ring 1
w Bias Magnet 1
x Reset (Look) Magnet 1
y Switch Magnet A 1
z Switch Magnet B 1
% Switch Ball 2

DRAWINGS

Reference Numerals

Exploded Drawing CEM FIG. 8: (a-z, %).
Case FIG. 9: (1-2); a(3); b(4).
Plate E FIG. 10: a(5); b(7-9); c(6).
Plate D FIG. 11: (21); a(12-13, 22); b(18-20); c(16).
Plate C FIG. 12: a(23); b(24-27); c(28-29).
Plate S1 FIG. 13: a(30-34); b(37-39).
Plate S2 FIG. 14: a(40-46); b(48-55).
Plate S3 FIG. 15: a(60-69); b(70-74).
Plate S4 FIG. 16: a(81-82); b(85-87).
Plate S5 FIG. 17: a(90-92); b(95-97).
Plate S6 FIG. 18: a(100-104); b(106-109).
Plate S7 FIG. 19: a(112,114,116); b(118-119, 121).
Plate S8 FIG. 20: a(125,127-128); b(129).
Plate S9 FIG. 21: a(130); b(131).
Caloric-Induction-Ring FIG. 22: a(141,143); b(145).
Shuttle FIG. 23: a(151,153,155); b(157,159).
Shuttle Ferrite element FIG. 24: a(160).
Caloric-Conductor(s) FIG. 25: a(165).
Plate S9A FIG. 26: a(170); b(172).
Electrical Heat Element FIG. 27: a(180); b(182).
Cerfite Ball FIG. 28: a(190).
Switch Magnet A FIG. 29: a(200); b(204).
Switch Magnet B FIG. 30: a(210); b(212).
Bias Magnet FIG. 31: a(220); b(224).
Lock Magnet FIG. 32: a(230); b(232).
Assembly Mixer in 3D FIG. 33: (235).
CEM Plate S2 Track FIG. 34: a(240); b(244,246).
CEM Plate S3 Track FIG. 35: a(250); b(252).
Pump_Rotor FIG. 36: a(260,262); b(264,266).

REFERENCES

Caloric energy storage spiral diameter 0.020 inch.

Total length 17.722408 in per layer includes inlet. Total of 3 layers storage one layer active. area 1.159551 in(2), 0.008052 ft., vol 0.058 cu. in.per layer.

Total oil in device volume of storage area 0.01627 oz., total volume in the entire machine 0.02146+−0.004 oz., rate of flow 0.0002 to 0.0007 oz per second, storage volume 0.174 cu in total volume 0.232 cu in.

The mathematical description of temperature in the storage is presented by a parabolic differential equation in partial derivatives:

$$C*(dU/dl)^2=dU/dt \quad (1)$$

Where U (t, l) is the function of the temperature in the caloric storage. We utilized here for the simplicity L, as the finite rod of the given length, C, as the constant of heat transformation of cotton seed oil (the oil is utilized in the device), which can be easily calculated numerically with the help of well-developed already technique of calculation of this value through viscosity of cotton seed oil under different temperatures. It is easy to understand that, in reality, X, Y, Z coordinates of the device can be presented as continuous without any irregularity's functions of L. For example, X=F (L), Y=G (L) and Z=Q (L). The full analytical (and numerical) presentation of these functions could be derived from the FIGS. 17,18, 19 of the device's illustrations. Once again, because these functions are continuous and have reverse continuous functions for the entire while of our consideration, the consideration of this problem can be presented, as a one-dimensional corresponding equation (1) for the search of analytical solution by traditional methods (see, for example, "The Course of High Mathematics", volume IV, by V. I. Smirnoff), this solution can be obtained as the traditional Green function for the one-dimensional case for a rod of given length and then transformed into U' (X, Y, Z) through substitution of their analytical values from L=F'(X), where F' is the reverse function of F(L), and through similarly constructed G'(Y) and Z'(Z).

Thus, the entire problem of mathematical calculations of problems, pertinent to caloric storage, would be presented by already well-developed techniques with the already existing proven theorems of existence and uniqueness of solutions.

DETAILED DESCRIPTION

First Embodiment

Now referring to FIG. 8. Within the Caloric Energy Manager the Quill is utilized in four different configurations: one on the hot-spots to aid the importing of caloric energy to those components; two in the Caloric Importing Ring to aid the transfer of caloric energy available outside the unit to the energy carrier media within the unit; three the Quill is utilized to form the Shuttle, which is a magnetically activated part, which, in its turn, rotates the pump rotor as it passes on each stroke, re-tracing on the return channel to next begin another stroke of the rotor in the next pass; four in CEM Plate S8, where Quills are interspersed along the spiral curve to eddy and convulse the media to enhance the transfer o caloric energy from the plate to the caloric energy transport media.

The Porcupine Quill is employed in the Caloric Energy Manager (CEM), an assembly of dual sided flat ceramic plates incorporating the spiral cavities in structure, magnetic, electromagnetic and electronic components designed to store and to manage the import of caloric energy into a FCHTMC engine. Contained within the Caloric Energy Manager Case is a stack of thirteen ceramic plates of various functions that also incorporate components of the Porcupine Quill, as further described, within this specification. The Caloric Energy Manager, as the caloric energy transfer and storage, use an oil as the caloric energy transfer media.

The oil when maintained in an evacuated atmosphere is allowed to achieve high temperatures without carbonation. The caloric energy sources cannot contact the oil directly as it is fully protecting the oil from boiling. The oil is circulated throughout the device by an electromagnetically controlled (Cerfite) rotary pump to transport and store caloric energy safely and securely. The caloric storage capabilities move from temporary with the Heat-Anvil to be semi-permanent with the CEM.

The media is guided through three circuits within the CEM, Loop 1 guides media from the pump up to the hot-spots (Caloric Conductors). An alternate: if switch ball A is open media from Caloric Storage is mixed with the Loop 3 media to increase caloric energy density. CEM, Loop 2 guides media up to the Caloric Induction Ring circuit, which encircles the upper outside edge of the turret relative to plates' E, D, and C, where the circular portion of the loop follows the one and a half-circle spiral, originating at the E plate then terminating at the C plate. The heated media may all be returned to the Storage Loop, which is the third loop. CEM, Loop 3 is composed of a half plate S4, which terminates the storage loop, and three plates (S5-S7) that have mirror matched spiral cavities to form spiral tubes between the plates with alternating entrances and exits to form a continuous tube, which cumulatively includes half of a fifth plate S8, which, in its turn, doubles as storage and caloric energy import transfer unit. Due to the angular material depth, the caloric energy is held secure as for caloric energy to leak it must have a path. The linear material between any possible caloric energy leak is guaranteed by the construction of the device. Each individual plate except plate S8 and S9A are made of minimally caloric energy conducting ceramic.

FIG. 8: It illustrates the Caloric Energy Manager (CEM) Exploded View and is an illustration for an assembly of ceramic; magnetic; electromagnetic and electronic components designed to manage the import of caloric energy into the FCHTMC engine. Contained within the Caloric Energy Manager Case (a) is a stack of thirteen ceramic plates and other components. The other 12 components are: Electrical Heating Element (b); Square Plate S9A (c); Square Plate S9 (d); Square Plate S8 (e); Square Plate S7 (f); Square Plate S6 (g); Square Plate S5 (h); Square Plate S4 (i); Square Plate S3 (j); Shuttle lower Guide Plate (k); Pump Rotor (1); Shuttle (m); Shuttle Ferrite (n); Shuttle upper Guide Plate (o); Square Plate S2 (p); Square Plate S1 (q); Turret Plate C (r); Turret Plate D (s); Turret Plate E (t); Caloric Conductors (u); Caloric Induction Ring (v); Bias Magnet (w); Reset (Lock) Magnet (x); Switching Magnet A (y); Switching Magnet B (z); Switch Balls (%).

The Caloric Energy Manager as the caloric energy transfer utilizes a media as the storage and energy transfer media. The media maintained in an evacuated atmosphere that allows it to achieve higher temperatures without carbonation. The caloric energy sources cannot contact the media directly in full, due to the fact that the ceramic surrounding is protecting the media from boiling. The media is circulated throughout the device by a rotary pump (I) to transport and store caloric energy under the control of the two switch magnets, the ball valves and outside electromagnetic forces.

Figure 9:
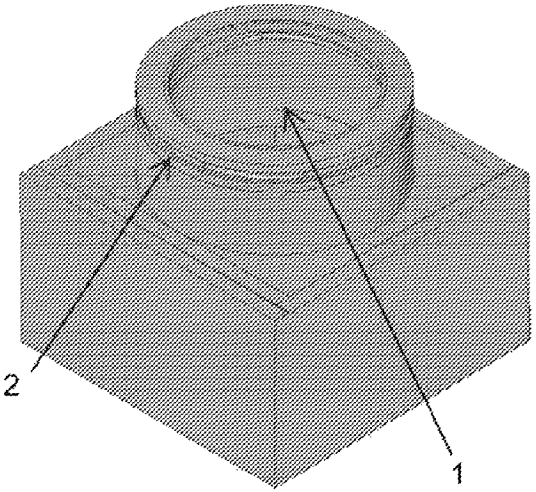
FIGS. 9, 9A, and 9B illustrate various perspectives of the Case.
Figure 9A:
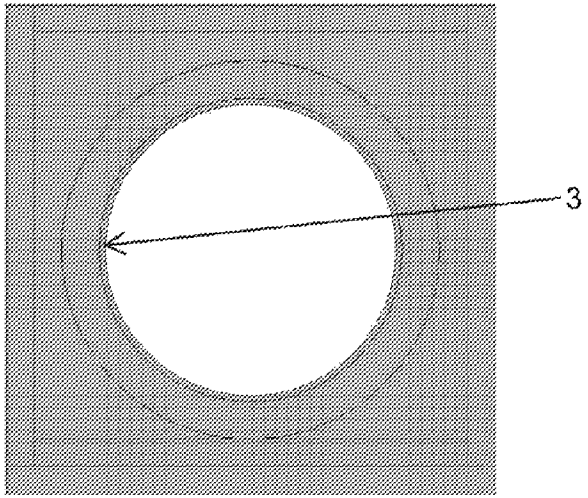
Figure 9B:
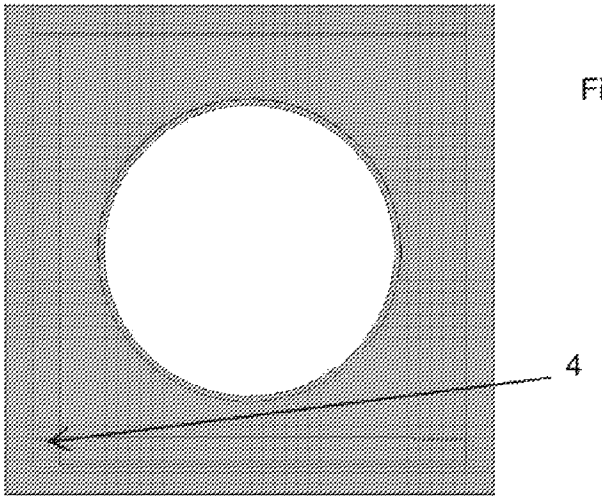
Figure 10C:
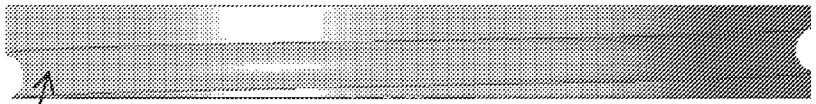
FIGS. 10, 10A, 10B, and 10C illustrate various perspectives of the Plate E.
Figure 10:
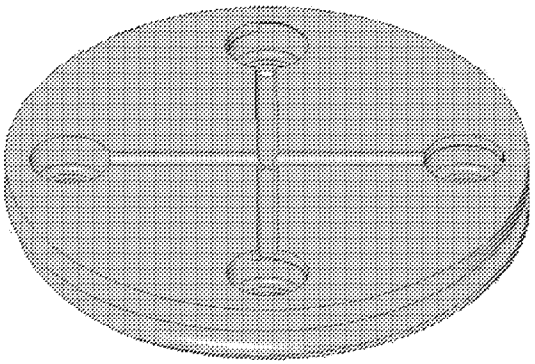

FIG. 9: It illustrates the Caloric Energy Manager Case, that encloses the caloric manager components. At the top, cavity (1) provides clearance for the hot-spots (Caloric Conductors, (FIG. 25)) to interface with the FCHTMC rotary expansion controls. Just below the edge of the turret on the outer surface is a geometrical partial cavity (2) with symmetrical through cavity holes at varying angles who provide access for the Cerfite Caloric Induction Ring (FIG. 22) that is mounted during the molding of the Case. FIG. 9*a*: The top of the turret has a reduced diameter cavity (3) to provide an upward seating edge for the CEM Plate E (FIG. 10). FIG. 9*b*: At the bottom of the case is a key extrusion (4), which proceeds up the inner square portion of the case to provide a position locking and seating edge to match the square cutout on each square plate, assuring that the plates may only be oriented and inserted facing upward towards the inside of the case.

Figure 10A:
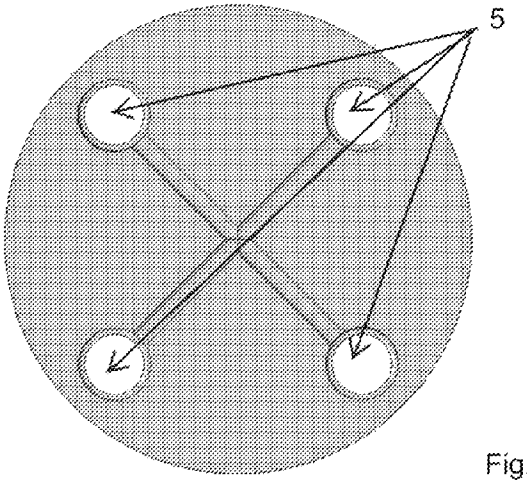
Figure 10B:
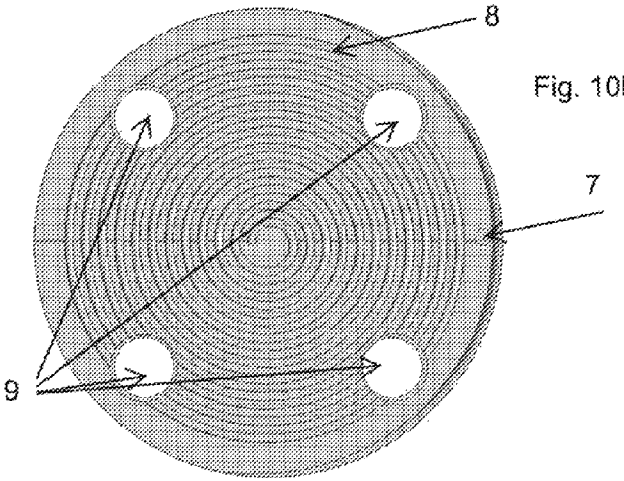

FIG. 10: It illustrates the CEM Plate E. FIG. 10*a*: It serves as the mounting manifold (5) for the four hot-spots, (FIG. 25). FIG. 10*b*: In addition, plate E serves as the starting point of the Caloric Induction Loop (7), that encircles the edge face of each turret plate. FIG. 10*c*: The half-circle cavity (6) progresses downward towards CEM Plate D (FIG. 11) to terminate on CEM Plate_C (FIG. 12). The Caloric Induction Loop works in concert with the Caloric Induction Ring (FIG. 22) that imports caloric energy into the caloric transfer media, surrounding the external outside surface of the turret of the CEM_Case (FIG. 9, 2). FIG. 10*b*: It illustrates the CEM Plate E lower surface, which is used to form the top half of the caloric energy embedding spiral (8) for the hot-spots (FIG. 25), whose bases protrude through the manifold. FIG. 10*b*: The curves of the hot-spots match the spiral (8) of the caloric energy embedding loop, while the Cerfite Quill round extrusions (9) assist to import caloric energy into the hot-spots from energy laden caloric energy transport media, flowing along the caloric energy embedding spiral.

Figure 11C:
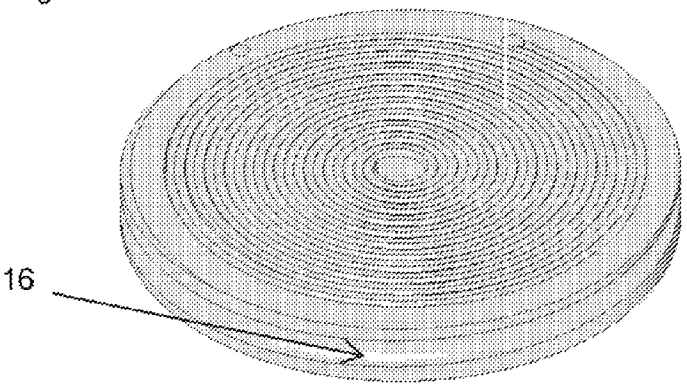
FIGS. 11, 11A, 11B, and 11C illustrate various perspectives of the Plate D.
Figure 11:
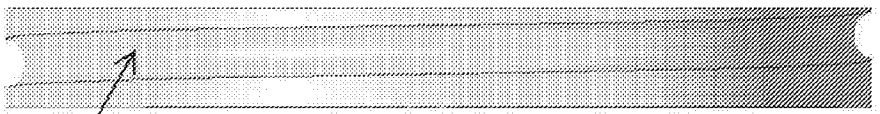
Figure 11A:
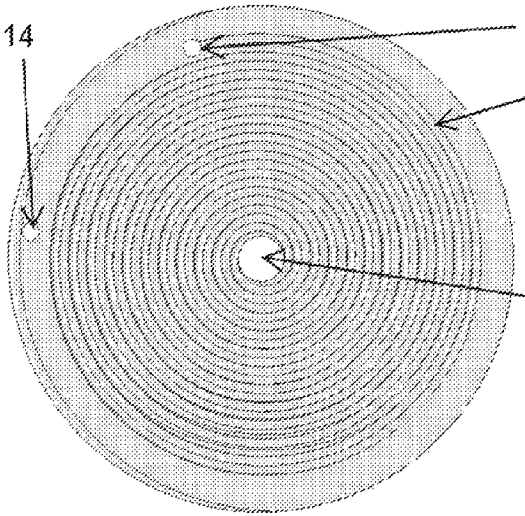
Figure 11B:
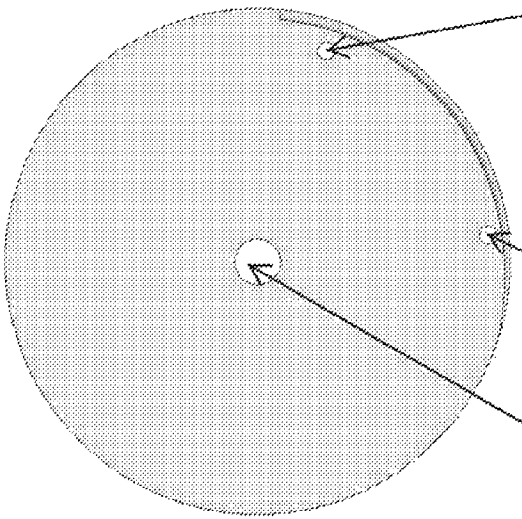
Figure 15:
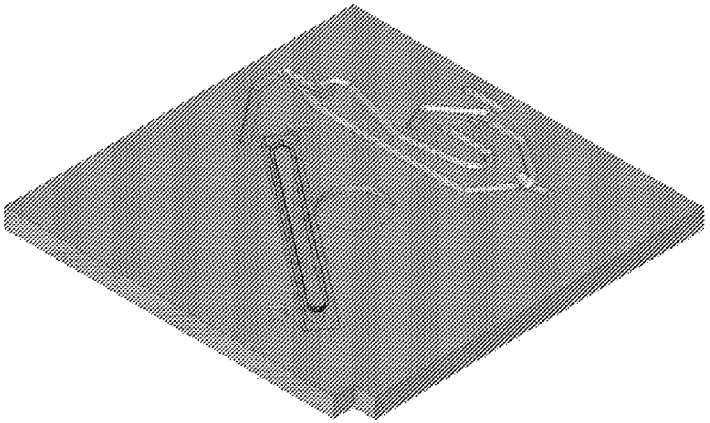
FIGS. 15, 15A, and 15B illustrate various perspectives of the Plate S3.

FIG. 11: It illustrates the CEM Plate D. FIG. 11*a*: On its top surface is the beginning of a spiral caloric energy embedding flow pattern (12), which is fed by the vertical circular through cavity (12) that ends at this surface. This cavity originates on CEM Plate S3 (FIG. 15). It guides energy laden caloric energy transfer media from the CEM Switch A default position. The caloric embedding spiral exits at the center of the plate (13), where the media exits by a large circular through cavity to CEM Plate C (FIG. 12). FIG. 11*b*: The circular through cavity (18) conveys caloric energy transport media to the hot-spot embedding spiral. The circular through cavity (19) conveys the caloric transport media to the Caloric Induction Loop origin (FIG. 10*b*), (7). The large circular through cavity (20) conveys the depleted caloric energy transfer media to the open cavity on CEM Plate C (FIG. 12*a*), (23). FIG. 11*c*: It circumscribes all along the edge of the CEM Plate E, progresses towards the outer edge spiral half circular cavity Caloric Induction Ring loop (16), which progresses, in its turn, around the plate edge face. FIG. 11: The half-circle cavity (21) progresses downward to CEM Plate C (FIG. 12). The circular through cavity (14) provides a source route for caloric energy transfer media destined to the Caloric Induction Ring loop, progressing up to CEM Plate E (FIG. 10*b*), (7).

Figure 13:
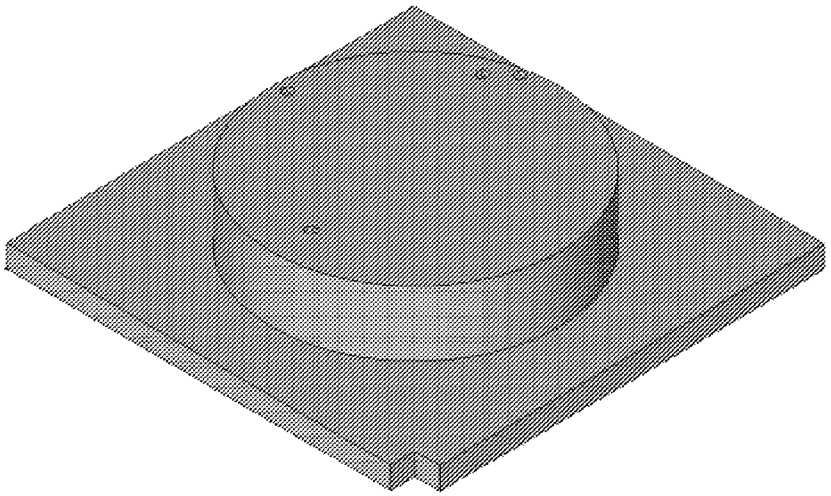
FIGS. 13, 13A, and 13B illustrate various perspectives of the Plate S1.

FIG. 12: It illustrates the CEM Plate C. FIG. 12*a*: It shows the geometrical circular entities that collect depleted caloric energy transport media into an open cavity then direct the media along a rectangular cavity to a circular through cavity (23). FIG. 12*b*: The depleted media is further directed through circular cavity (27) to the CEM Plate S1 (FIG. 13). The Caloric Induction Loop half-circle cavity (28) progresses from the CEM Plate D, spiraling downward to the circular cavity (29). FIG. 12*c*: The edge face routing terminates the media into a circular cavity (29) that then continues to CEM Plate S1. FIG. 12*b*: The circular cavity (24) conveys media to CEM Plate S1 (FIG. 13). The circular through cavity (25) supplies caloric energy transport media to the top of the CEM Plate D, where it then enters the hot-spot caloric embedding spiral (FIG. 11*a*), (12). The circular through cavity (26) supplies caloric energy transport media to the Caloric Induction Ring loop, which originates on the CEM Plate E (FIG. 10*b*), (7).

Figure 13A:
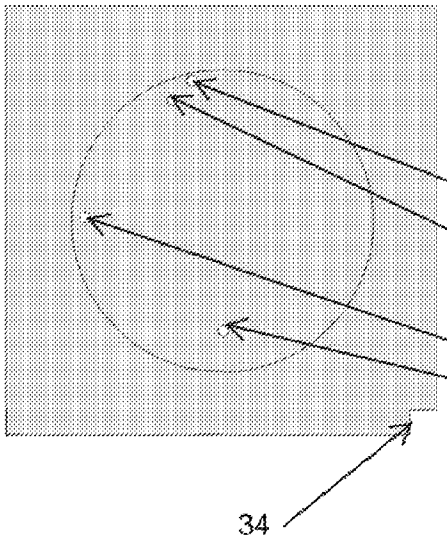
Figure 13B:
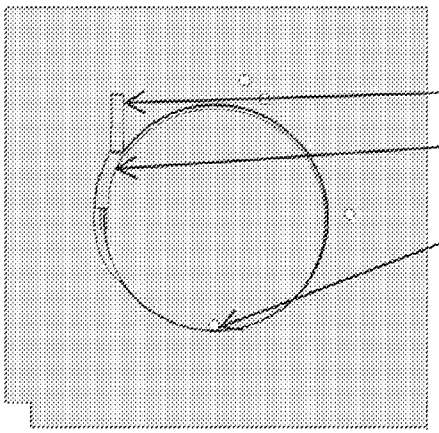

FIG. 13: It illustrates the CEM Plate S1. It has a primary function to house the caloric transport media pump rotor (FIG. 24), a secondary function is to provide circular through cavity extensions for the circular cavities progressing to and from the CEM Plate C. FIG. 12*a*: Circular through cavities (24-27) are the through cavities previously mentioned. The circular through cavity (30) transports the Caloric Induction Ring output to the CEM Plate S2. The circular through cavity (31) transports the caloric energy laden media towards the corresponding cavity in CEM Plate C (FIG. 12). The circular through cavity (FIG. 13*a*), (32) transports the caloric transport media from the CEM Plate S2 (FIG. 14) towards the corresponding cavity in CEM Plate C (FIG. 12). The circular through cavity (33) transports depleted caloric energy media from the CEM Plate C (FIG. 12) to the inner pump chamber. FIG. 13*b*: It illustrates the circular through cavity (37), which is the inlet for depleted media to the pump chamber. The inside wall of the CEM Plate S1 pump chamber provides a splash guide (38) to assist the capture of the centrifugal output of the pump as well as the impeller output directing media towards the exit cavity for the caloric energy transport media (39). The standard alignment key on all CEM Plate S series assures the proper orientation of the plates (FIG. 13*a*, 34).

Figure 14:
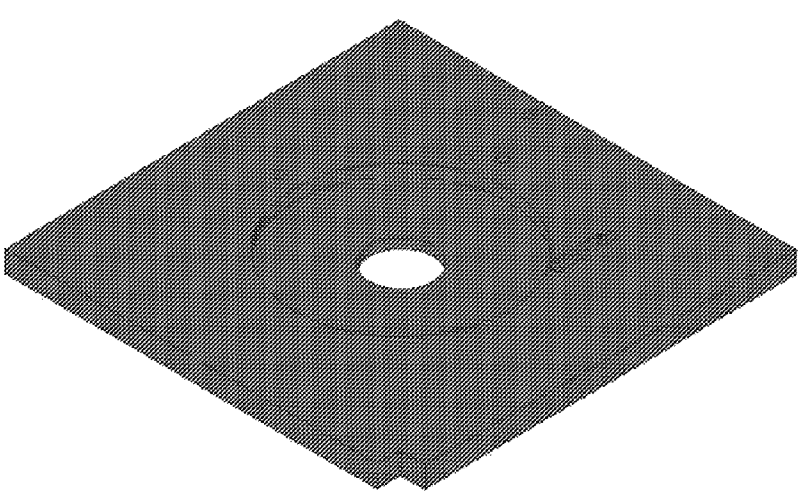
FIGS. 14, 14A, and 14B illustrate various perspectives of the Plate S2.

FIG. 14: It illustrates the CEM Plate S2, which is the top partner of a two plate assembly with geometrical cavities, ceramic and Cerfite components contained within. The plates may be simply referred to as the caloric energy transfer media switch and driver of media, as these plates contain components within and perform all the variable functions of the system.

Figure 14A:
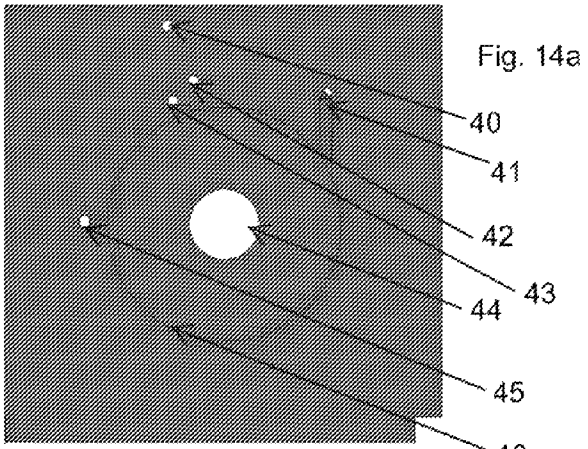

FIG. 14*a*: The circular through cavity (40) is the origin of the caloric energy transport media return to Storage Loop path from the Switch B default cavity formed between CEM Plate S2 (FIG. 14) and CEM Plate S3 (FIG. 15). The circular through cavity (41) transfers the collected caloric energy transport media pushed by the pump to the CEM Plate S2 Mixer cavity (FIG. 14*b*), (51), (FIG. 33), (235). The circular through cavity (42) receives Caloric Induction Loop output from CEM Plate S1 (FIG. 13), routing the media into the Switch B cavity that is created between CEM Plate S2 (FIG. 14) and CEM Plate S3 (FIG. 15). The circular though cavity (43) carries caloric energy transport media from the Switch A cavity to the CEM Plate S1, the destination is the Caloric Embed Loop, originating on the CEM Plate E (FIG. 15). The circular through cavity (44) forms the mating surface to the media pump (FIG. 24) hub to circulate within. The circular through cavity (45) transports caloric energy transport media from the Switch B hot cavity to CEM Plate 51 (FIG. 13), and the destination is the Caloric Induction Loop that originates on CEM Plate E (FIG. 10). The circular cavity (46) is the support cavity for the caloric energy transport media pump rotor (FIG. 24), which circulates within.

Figure 14B:
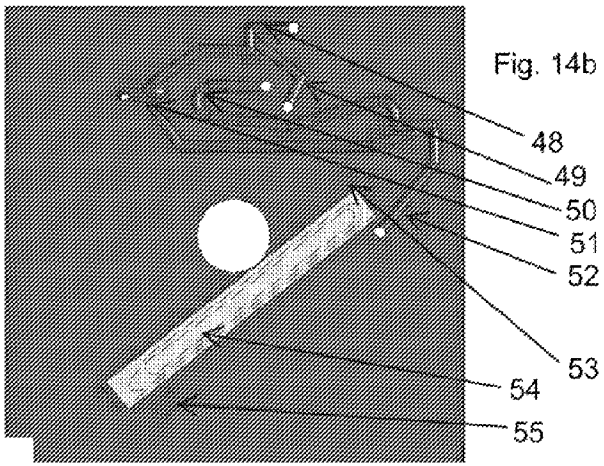

FIG. 14*b*: It presents the Switch A default geometrical cavity (48), which routes to the Mixer (FIG. 33), (235) output to the storage loop bottom level. The Switch A hot geometrical cavity (49) routes to mixer (FIG. 33), (235) output to the CEM Plate S1 destination-the hot-spot embedding loop, which originates on CEM Plate E (FIG. 10). The geometrical cavity (50) routes the Caloric Induction Loop output to the Switch B. The geometrical cavities (51), which construct the caloric energy transport media Mixer. The geometrical cavity (52) routes the output from the Switch B default conduit to the CEM Plate S1 destination cavity (FIG. 14*a*), (45), which feeds the circular cavity, while proceeding to the Caloric Induction Loop, which, in its turn, originates on CEM plate E (FIG. 10). The Cerfite Lock Magnet is a permanent magnet that captures the Shuttle (FIG. 33) then locks it into a safe state. The Cerfite shuttle track (54) is a construction that provides a power channel and a retrace channel, both linked by restricted movement areas designed to keep the shuttle properly oriented, while under modifying position, due to magnetic forces. The Cerfite Bias Magnet (55), which causes the shuttle to park lightly against the side of the area once electromagnetic forces recede. The weak magnetic force of the Bias Magnet is soon overcome by the stronger force of the Lock Magnet, which is barely intense enough to pull the shuttle back to lock position on the return channel. The geometrical cavity (52) routes the output from Switch B default to the CEM Plate S1, destination of the Caloric Induction Loop input, which is originated on CEM Plate E (FIG. 10).

Figure 15A:
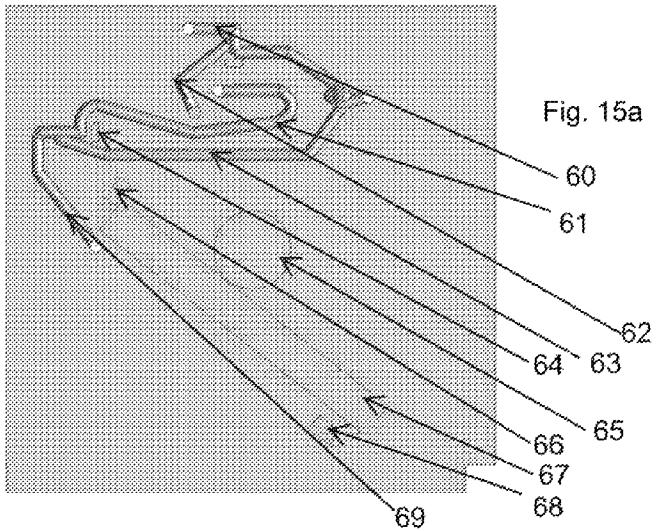

FIG. 15: It illustrates the CEM Plate S3. FIG. 15*a*: It is 80% of a mirror implementation of the geometrical cavities of the CEM Plate S2 bottom side (FIG. 14*b*). The differences are the central cavity is not a through cavity but a shallow cavity ½ the depth of the plate. The geometrical cavity (60) is the mirror half of the Switch A default cavity, which is defined by (FIG. 14*b*), (48). The geometrical cavity (61) is the mirror half of Caloric Induction Ring output defined, as (FIG. 14*b*), (50). The geometrical cavity (62) is the mirror half of the Switch A hot output cavity to CEM Plate S1 circular cavity (13*a*), (31), where the destination to be is the hot-spot embedding spiral. The geometrical cavity (63) is to transport caloric energy transfer media to bypass from the Mixer, when pressure from the pump causes back-flow from the Storage Loop. The geometrical cavity (64) is a mirror cavity route for the Switch B magnet. The geometrical cavity (65) allows the Pump-Rotor (FIG. 24) hub to seat, while allowing the hub to rotate freely on center. The geometrical cavity (66) is the mirror cavity for the Lock Magnet (FIG. 32). The geometrical cavity (67) is the designated cavity for the CEM Plate S3 track (FIG. 36). The geometrical cavity (68) is the mirror cavity for the Bias Magnet. The geometrical cavity (69) is the mirror half of the cavity of Switch B default destination, the Caloric Induction Ring Loop fed by the circular cavity (FIG. 13*a*), (32).

Figure 15B:
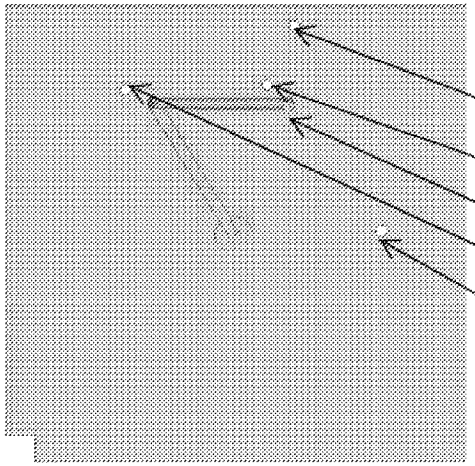

FIG. 15*b*: The circular through cavity (70) continues to the Return to Storage Loop and proceeds from the Switch A default cavity (FIG. 15*a*), (60). The rectangular geometrical cavity with the circular through cavity (71) is the Caloric Induction Ring Loop output from the CEM Plate S1 (FIG. 13*a*), (30). The circular cavity (72) is the CEM Caloric Embedding Loop to CEM Plate S1 (FIG. 13*a*), (31). The circular through cavity (73) conveys the Mixer fed from Storage Loop output (FIG. 16*a*), (81). The circular through cavity (74) conveys media to the Caloric Induction Ring to CEM Plate E (FIG. 10).

Figure 16:
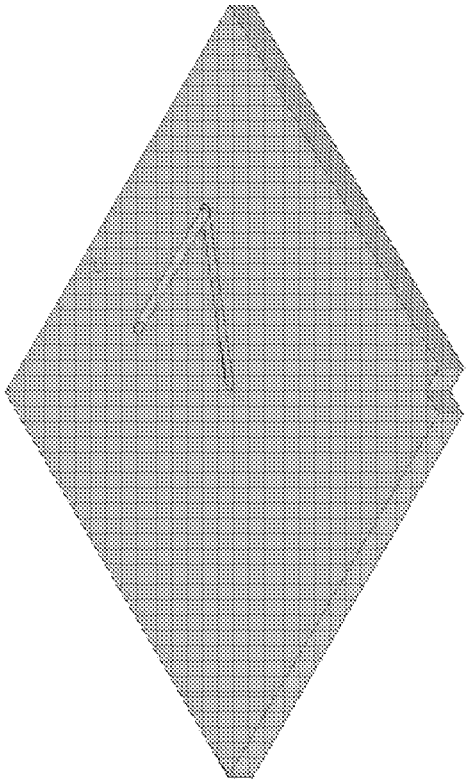
FIGS. 16, 16A, and 16B illustrate various perspectives of the Plate S4.
Figure 16A:
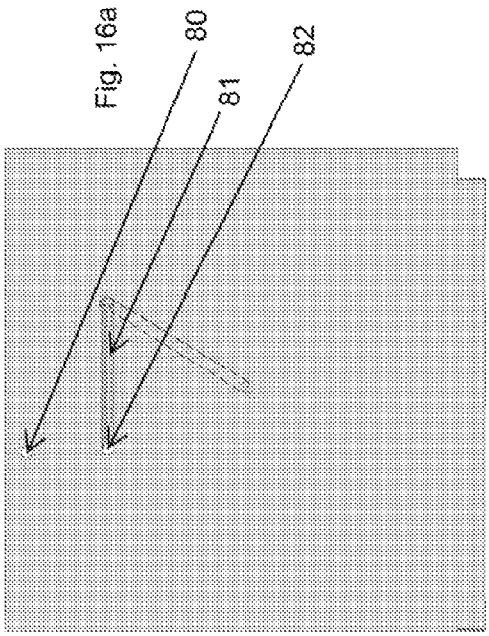
Figure 20:
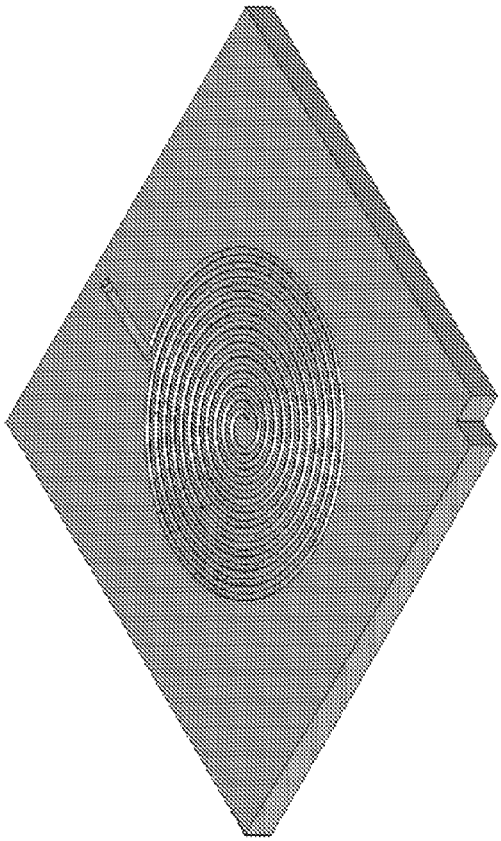
FIGS. 20, 20A, and 20B illustrate various perspectives of the Plate S8.

FIG. 16: It illustrates the CEM Plate S4. FIG. 16*a*: It shows the top surface to interface with CEM Plate S3, while on its bottom surface, it is the last spiral cavity of the Storage Loop component. The circular through cavity (80) is the continued conveyance of the depleted energy transport media to the initial point of the Storage Loop on CEM Plate S8 (FIG. 20). The rectangular geometrical cavity (81) conveys the energy transport media into the Caloric Embedding spiral (FIG. 15*b*), (72). The circular through cavity (82) exits from the Storage Loop into the Mixer that is located between CEM Plate S2 (FIG. 14*b*), (51) and CEM Plate S3 (FIG. 15*b*), (73).

Figure 16B:
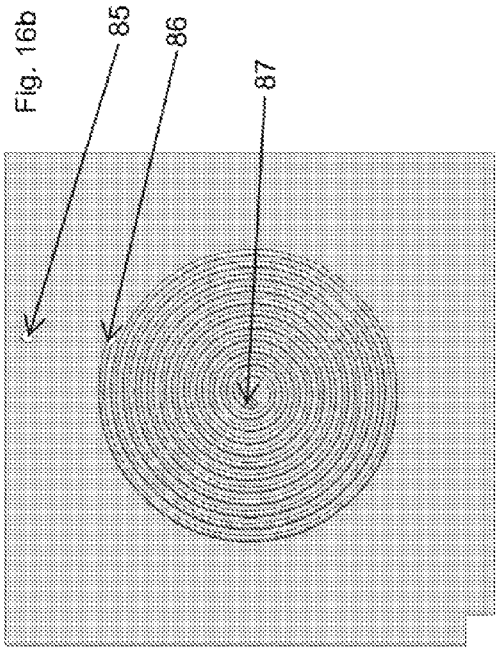

FIG. 16*b*: The circular through cavity (85) conveys the depleted caloric energy transfer media to the next level towards the origin of the Storage Loop on CEM Plate S8 (FIG. 20). The circular through cavity (86) forms the terminus of the 4th Storage Loop spiral storage cavity. This one conveys the energy laden caloric energy transport media to circular cavity (FIG. 16*a*), (82) into the Mixer. The circular cavity (87) forms the terminus of the up-welling from the 3rd Storage Loop conveyed by the circular through cavity (FIG. 17*a*), (92).

Figure 17:
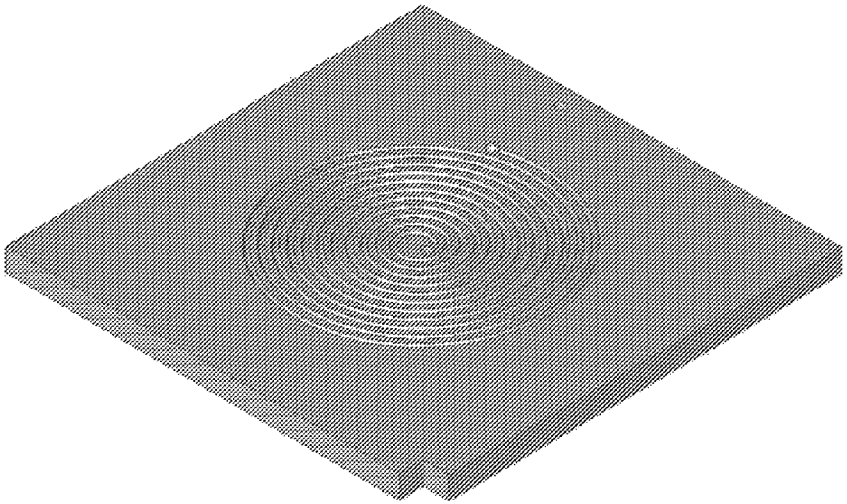
FIGS. 17, 17A, and 17B illustrate various perspectives of the Plate S5.
Figure 17A:
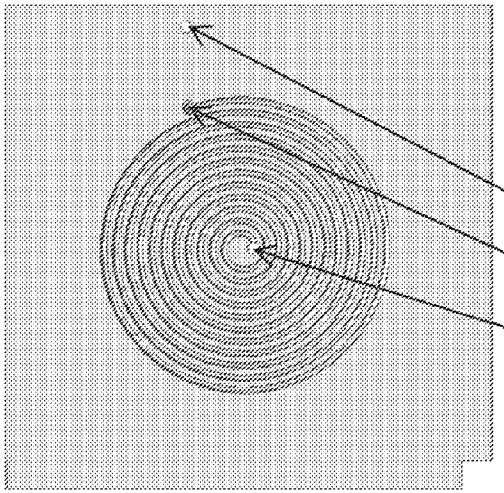

FIG. 17: It illustrates the CEM Plate S5, an energy storage plate. FIG. 17*a*: The circular through cavity (90) conveys the depleted caloric energy transport media to the first Storage Loop level on CEM Plate S8 (FIG. 20). The circular cavity (91) from the terminus of the 4th Storage Loop levels in concert with the mirror circular through the cavity on CEM Plate S4 (FIG. 16*b*), (87). The circular through cavity (92) conveys the up-welling of caloric energy transfer media from the Storage Loop third level.

Figure 17B:
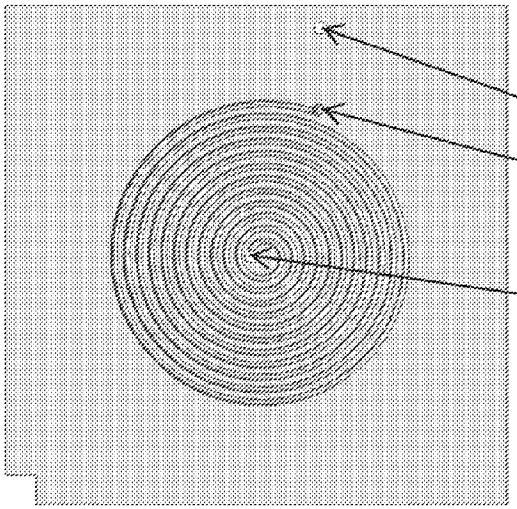

FIG. 17*b*: The circular through cavity (95) is the terminus of the circular through cavity (FIG. 17*a*), (90). The circular cavity (95) is the continuance of circular cavity (FIG. 16*a*), (90). The circular cavity (96) is the terminus of the spiral on the 4th Storage Loop level in combination with the circular through cavity (FIG. 16*b*), (86). The circular through cavity (97) is the up-well to level two in concert with (FIG. 16*a*), (92).

Figure 18:
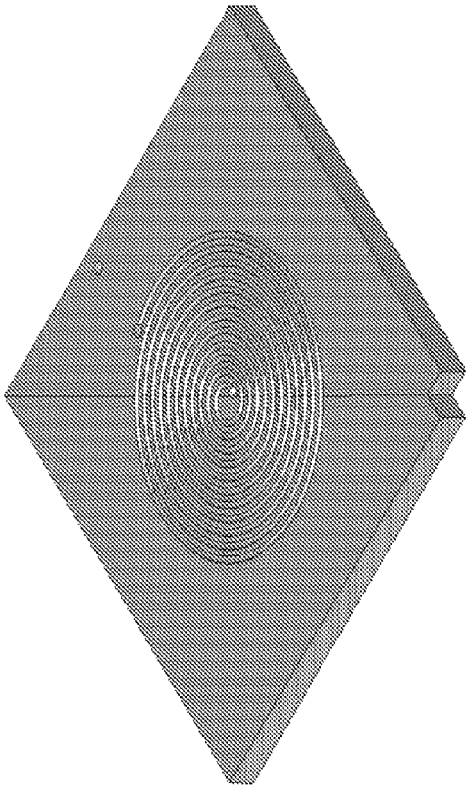
FIGS. 18, 18A, and 18B illustrate various perspectives of the Plate S6.
Figure 18A:
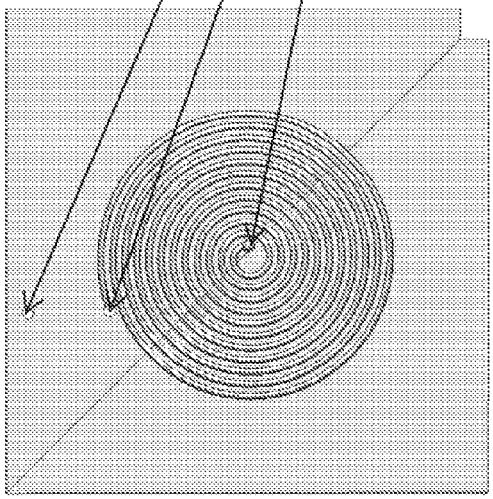

FIG. 18: It illustrates the CEM Plate S6, as an energy storage plate. FIG. 18*a*: The circular through cavity (100) conveys the depleted caloric energy transport media to the first Storage Loop level. The circular through cavity (102) conveys the up-well originated on (FIG. 18*b*), (108). The circular cavity (104) serves as the terminus of circular through cavity (FIG. 17*b*), (97).

Figure 18B:
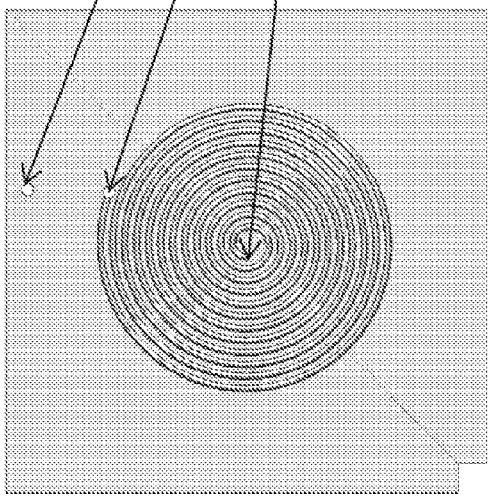

FIG. 18*b*: The circular through cavity (106) conveys depleted caloric energy transfer media to the first Storage Loop level. The circular through cavity (108) conveys up-welling caloric energy transport media that originates on CEM Plate S7 (FIG. 19*a*), (116). The circular cavity (109) serves as the terminus of the spiral then the up-welling to Storage Loop level three that is conveyed through circular through cavity (FIG. 17*a*), (92).

Figure 19:
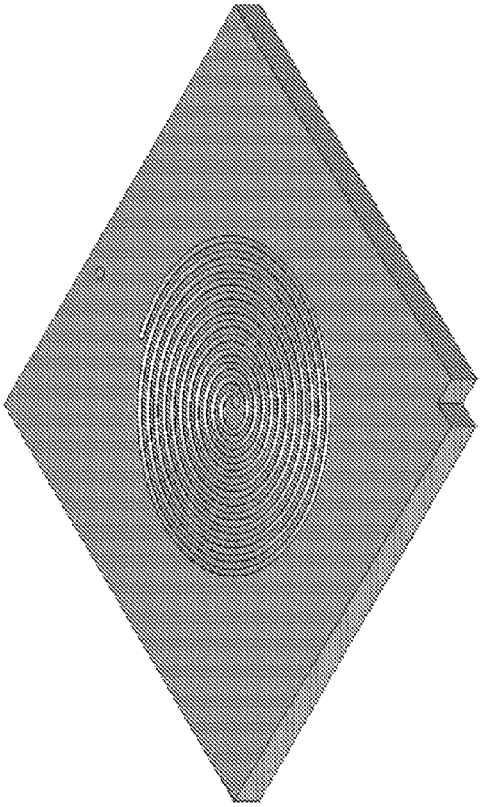
FIGS. 19, 19A, and 19B illustrate various perspectives of the Plate S7.
Figure 19A:
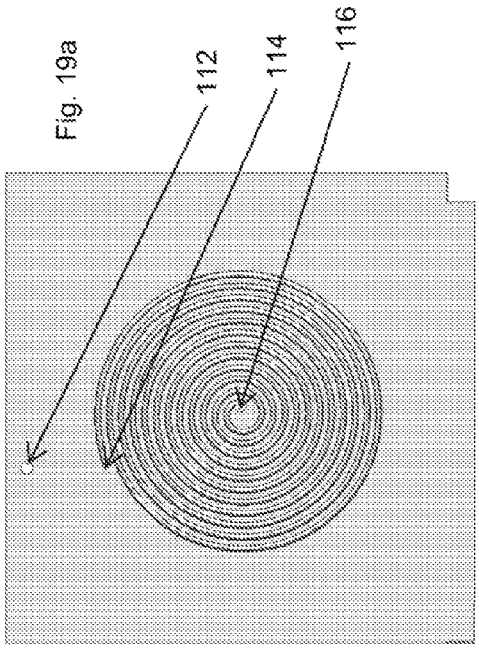

FIG. 19: It illustrates the CEM Plate S7 an energy storage plate. FIG. 19*a*: The circular through cavity (112) conveys depleted caloric energy transport media to the first Storage Loop level through the circular through cavity (FIG. 19*b*), (118). The circular cavity (114) serves as the terminus of the up-welling conveyed through circular through cavity (FIG. 18*b*), (108). The circular through cavity (116) conveys the up-welling, which origin is at the circular through cavity (FIG. 20*a*), (128).

Figure 19B:
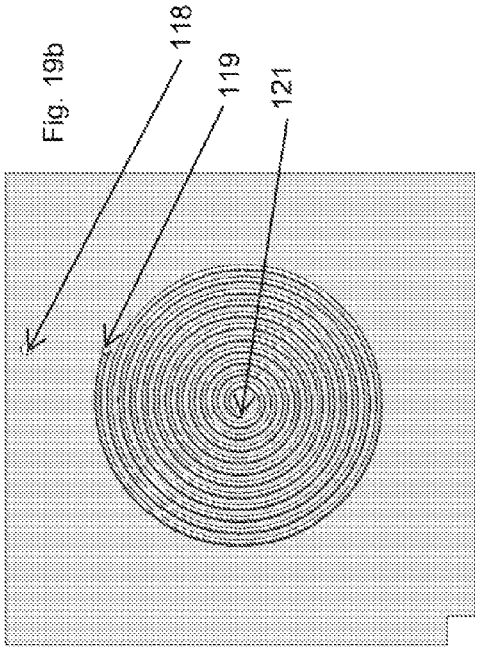

FIG. 19*b*: The circular through cavity (118) conveys depleted caloric energy transport media to the first Storage Loop level (FIG. 20*a*), (125). The circular cavity (119) conveys caloric energy transport media into the Storage Loop spiral cavity, originating the media at the terminus of the rectangular geometrical cavity (FIG. 20*a*), (125).

Figure 20A:
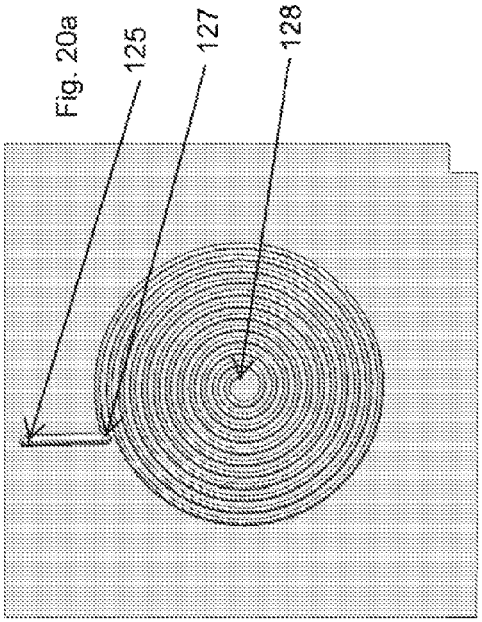

FIG. 20: It illustrates the CEM Plate S8 is an energy embedding storage plate. FIG. 20*a*: The rectangular geometrical cavity (125) conveys caloric energy transport media, guiding it to the spiral storage element (127). This Storage Loop level differs from every other storage level. As shown in (FIG. 3), the spiral is interspersed with many Cerfite quills, while the plate itself is also made of thermal conducting Cerfite material. These features provide the possibility to embed the media with caloric energy transformed by a heating-coil (FIG. 27) that is activated by a wall transformer or other proper direct current source. The circular cavity (128) is the terminus of the Storage Loop level 1. The caloric energy transport media is up-welled through the circular through cavity (FIG. 19*b*), (121).

Figure 20B:
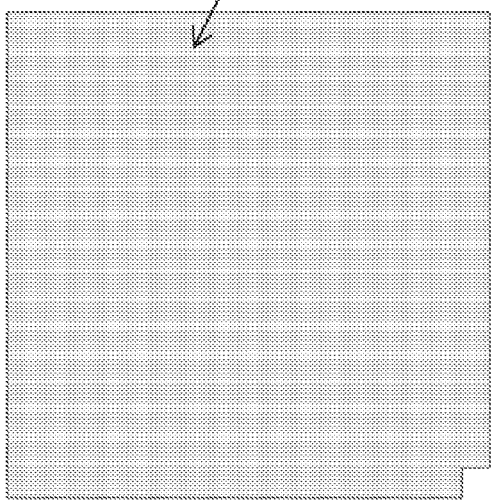

FIG. 20*b*: The bottom (129) surface of CEM Plate S8 is slightly buffed as to closely mate with CEM Plate S9A, the interim buffer plate (FIG. 26). Heat sink compound is placed on both sides of the interim plate to aid the transfer of caloric energy.

Figure 21:
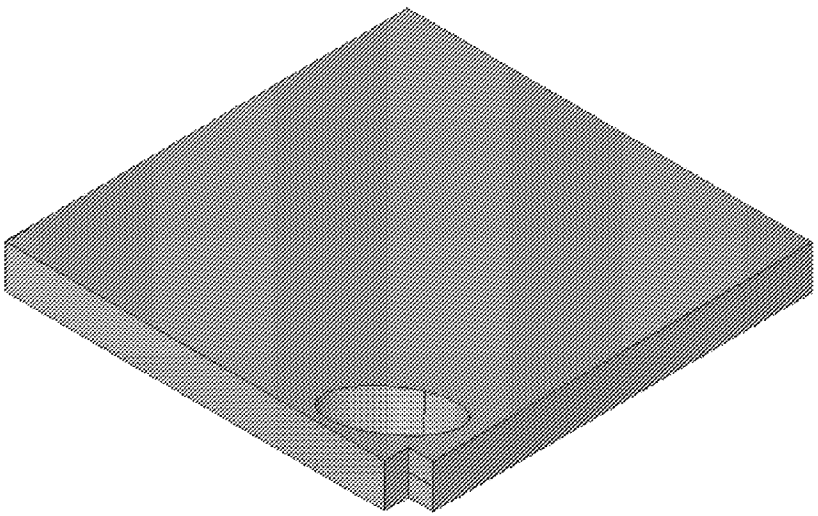
FIGS. 21, 21A, and 21B illustrate various perspectives of the Plate S9.
Figure 21A:
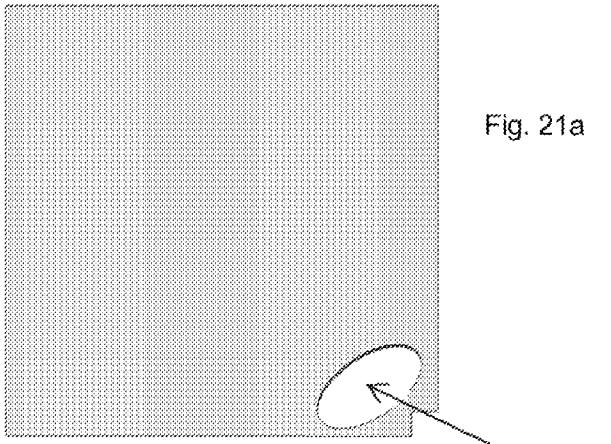
Figure 21B:
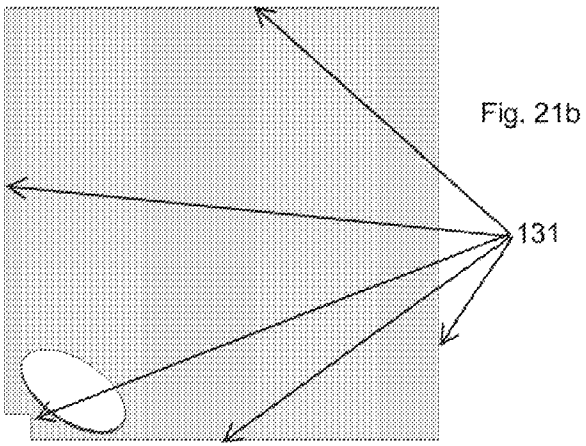

FIG. 21: It Illustrates the CEM Plate S9, the final plate in the caloric-energy manager. FIG. 21*a*: The S9A plate has two functions: thermal isolation and electrical supply lead access, which is managed through angled oval cavity (130) that is designed to support the cable, which shall be fixed by RTV application. FIG. 21*b*: The secondary function of thermal isolation is completed as the edge plate S9 (131) is sealed to the case (FIG. 9) by the application of RTV around all external edges.

FIG. 22: It Illustrates the Cerfite CEM Caloric Induction Ring, which is constructed solely of caloric energy conducting ceramic. FIG. 22*a*: The ring body (143) snugly conforms to the groove in the turret (FIG. 9), (2). FIG. 22*b*: All of the eight (145) Cerfite pins that protrude from the ring body to proceed through the Case Turret wall (FIG. 9) (2) into a groove cut for them inside of the turret. The groove and the quill's angle follow within that alignment centered on the plate E edge, facing spiral routing (FIG. 10*c*), (6). This construction optimizes induction of energy transfer to embed into the caloric energy transport media as the media circumscribes the spiral path between the inside turret surface and the half-circle cavity of the Caloric Induction loop.

Figure 23:
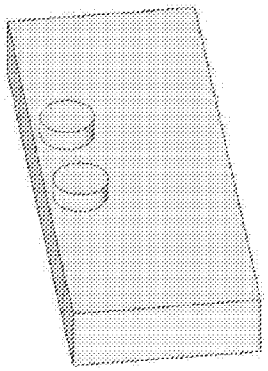
FIGS. 23, 23B, and 23B illustrate various perspectives of the Shuttle.
Figure 23A:
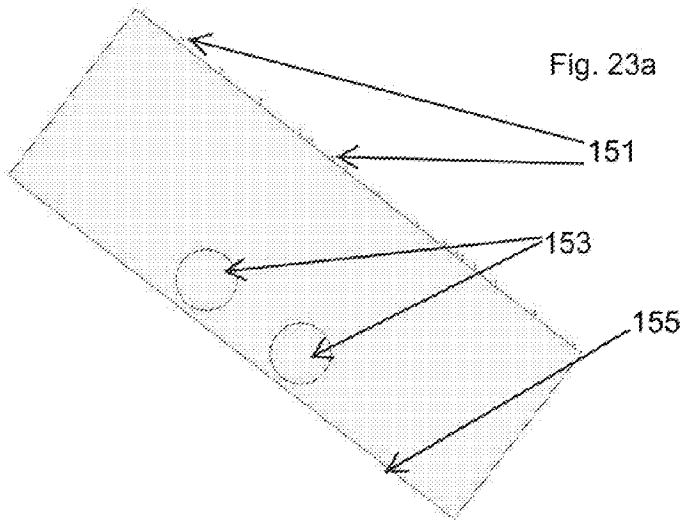
Figure 23B:
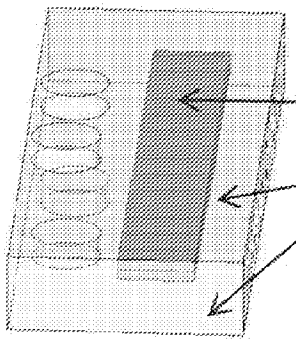

FIG. 23: It illustrates the Shuttle, a Cerfite construction, of non-caloric energy conducting ceramic. FIG. 23*a*: The geometrical dome protrusions (151) interface with the extended serrations of the pump-rotor base (268) to influence the hub rotation in accommodation with the Shuttle, passing the serrations in a perpendicular motion, which affects the angular motion between the rotating serrations and the semi-dome extrusions. The dual circular extrusions on top and bottom provide a four point (2-S2, 2-S3) channel (FIG. 34, FIG. 35) interface to ensure that the Shuttle maintains a proper and stable trajectory, while sliding along the channel. The rear surface of the Shuttle slides against the central raised buttresses of both tracks (FIG. 35*b*), (252) to enhance shuttle stability, while sliding. The geometrical cavity (FIG. 34), (244) is mirrored in each track (FIG. 34*b*, 35*a*), (246, 250), and is a channel to guide the Shuttle through a complex trajectory, which allows the Shuttle to follow a power stroke, then to perform a retrace stroke without any mechanical springs or belts. FIG. 23*b*: The rectangular soft-ferrite (157) embedded within the Shuttle provides magnet influence capability to the ceramic, allowing electromagnetic and magnetic control of the part in its sliding movements. The physical component of the Shuttle (159) is a precisely defined and extremely stable entity to insure uninhibited movement within the tracks (FIG. 34, 35) with extended wear characteristics.

Figure 24:
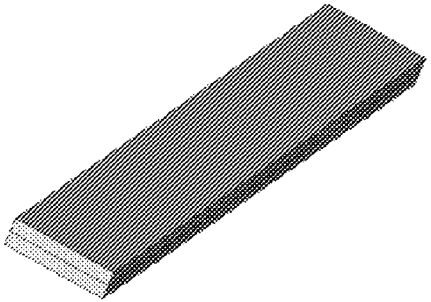
FIGS. 24 and 24A illustrate various perspectives of the Shuttle ferrite element.
Figure 24A:
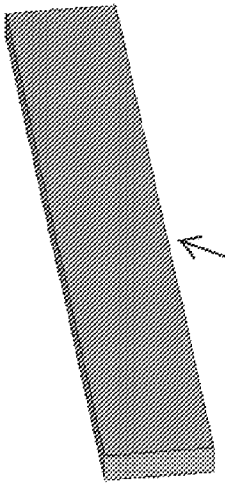

FIG. 24: It illustrates the pressed soft-ferrite magnetic interface component of the Shuttle. FIG. 24*a*: It shows that the pressed material is loosely confined within the Shuttle to allow for different thermal expansion of their characteristics.

FIG. 25: It illustrates the hot-spots that are constructed entirely of caloric energy, conducting ceramic. FIG. 25*a*: The four hot-spots (165) are each individually matched to their Caloric Embedding Spiral position. The devices are unique in this way. Therefore, one may not be interchanged with the other. Each hot-spot has Cerfite pins within curves that are matching the embedding spiral (FIG. 1), (168).

FIG. 26: It illustrates the CEM Plate S9A that is entirely constructed of caloric energy conducting ceramic. FIG. 26*a*: The surface of the plate (170) is slightly roughed to enhance the thermal transfer to heat-sink compound, the S9A plate acts as a thermal buffer, where it equalizes out the caloric energy created by the electric coil (FIG. 27). The plate also retains heat after the electrical coil has de-energized, allowing a gradual reduction of caloric energy embedded with the caloric energy transport media. FIG. 26*b*: The bottom side of CEM Plate S9A has an identical characteristics, as the top has.

FIG. 27: It illustrates the Electrical Heating Coil. FIG. 27*a*: The heating coil is designed to provide the proper wattage for the application. This coil does not get red-hot but cycles on and off under control of the temperature of the CEM Plate S9A (FIG. 26) to maintain approximately 160 degrees Fahrenheit on the plate. FIG. 27*b*: The return leg of the heating coil is a non resistive leg to avoid creating uneven heating zones.

Figure 28:
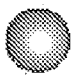
Figure 28A:
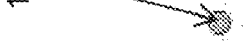

FIG. 28: It illustrates the Cerfite Ball valve or actuator that is constructed of non-caloric energy conducting ceramic. FIG. 28*a*: The soft-ferrite core (190) of the Cerfite Ball provides a magnetic response to the ceramic.

Figure 29:
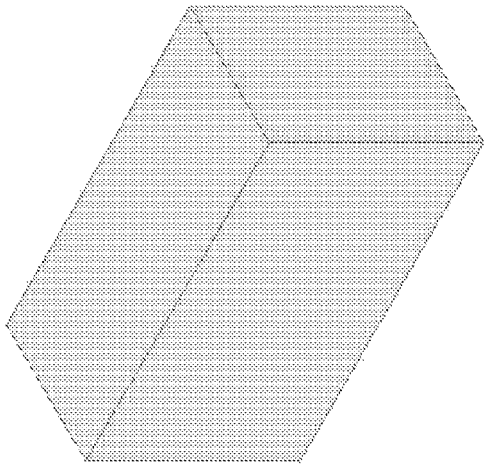
FIGS. 29, 29A, and 29B illustrate various perspectives of the Switch Magnet A.
Figure 29A:
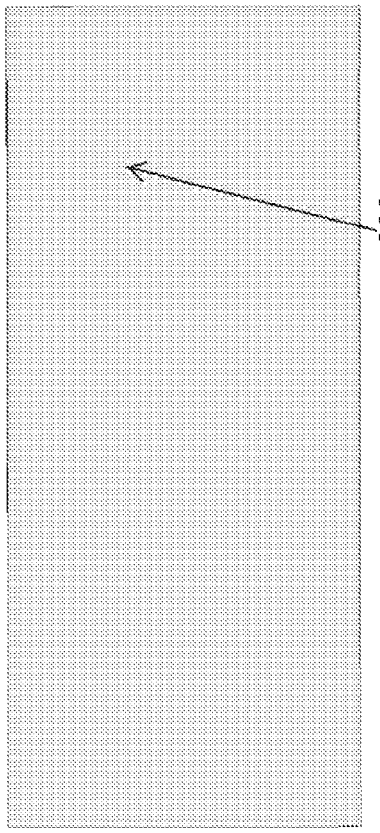
Figure 29B:
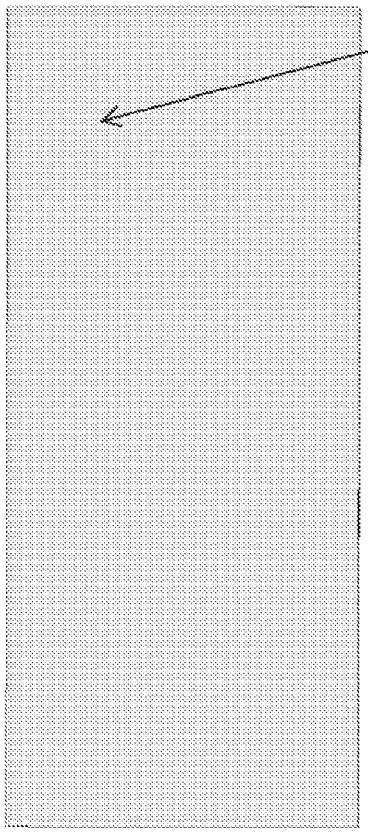

FIG. 29: It illustrates the Switch Magnet A, a hard-ferrite construction. FIG. 29*a*: The molded hard-ferrite material (200) is magnetized permanently to the proper intensity, as necessary, for the application. FIG. 29*b*: There is not any requirement to encase the ferrite (204) in ceramic, as there is not any acid or other oxidizing agent within the construction.

Figure 30:
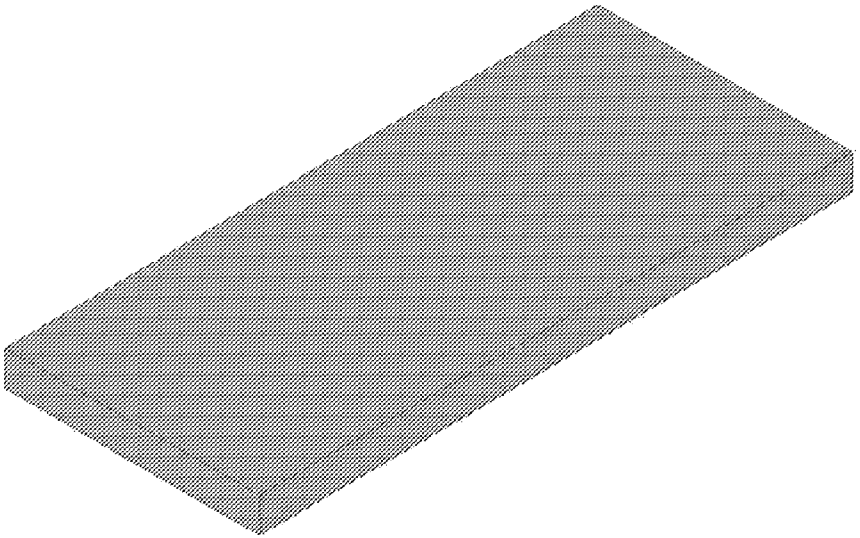
FIGS. 30, 30A and 30B illustrate various perspectives of the Switch Magnet B.
Figure 30A:
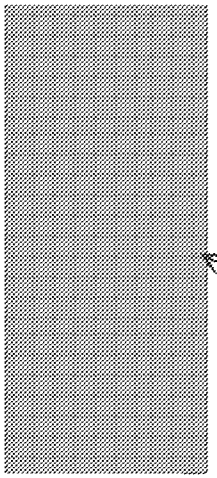
Figure 30B:
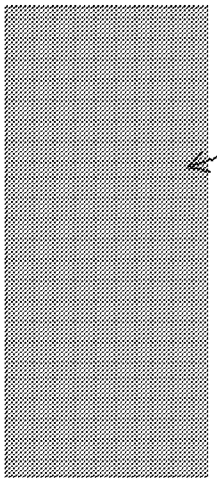

FIG. 30: It illustrates the Switch Magnet B, a hard-ferrite construction. FIG. 30*a*: The molded hard-ferrite material (102) is magnetized permanently to the proper intensity, as necessary, for the application. FIG. 30*b*: There is not any requirement to encase the ferrite (212) within ceramic, as there is not any acid or other oxidizing agent within the construction.

Figure 31:
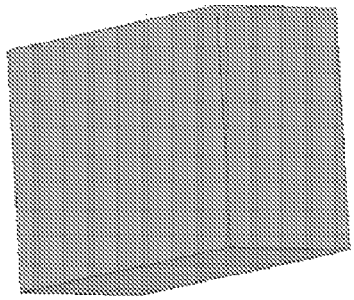
FIGS. 31, 31A, and 31B illustrate various perspectives of the Bias Magnet.
Figure 31A:
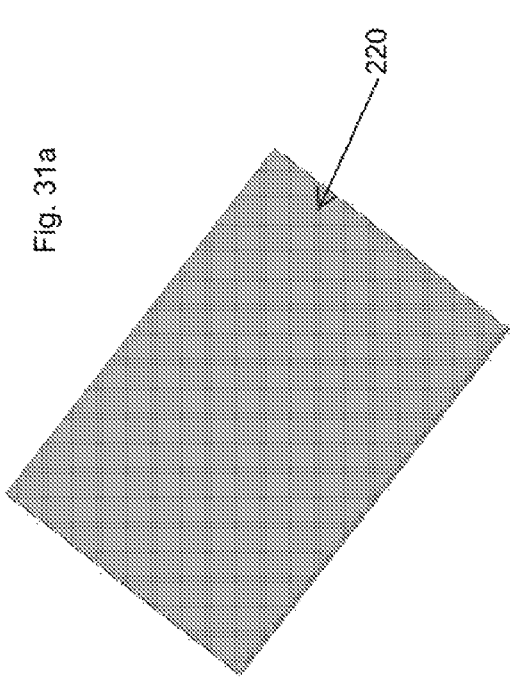
Figure 31B:
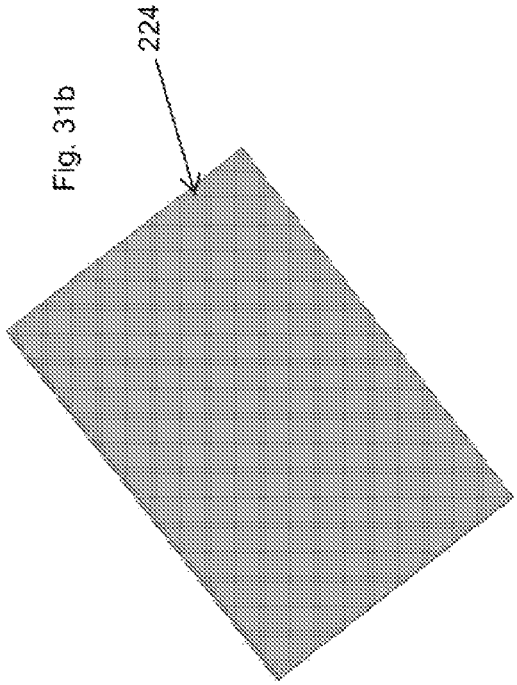

FIG. 31: It illustrates the Bias Magnet, a hard-ferrite construction. FIG. 31*a*: The molded hard-ferrite material (202) is magnetized permanently to the proper intensity, as necessary, for the application. FIG. 30*b*: There is not any requirement to encase the ferrite (224) within ceramic, as there is not any acid or other oxidizing agent within the construction.

FIG. 32: It illustrates the Lock Magnet, a hard-ferrite construction. FIG. 32*a*: The molded hard-ferrite material (230) is magnetized permanently to the proper intensity, as necessary, for the application. FIG. 32*b*: There is not any requirement to encase the ferrite (322) within ceramic, as there is not any acid or other oxidizing agent within the construction.

Figure 33:
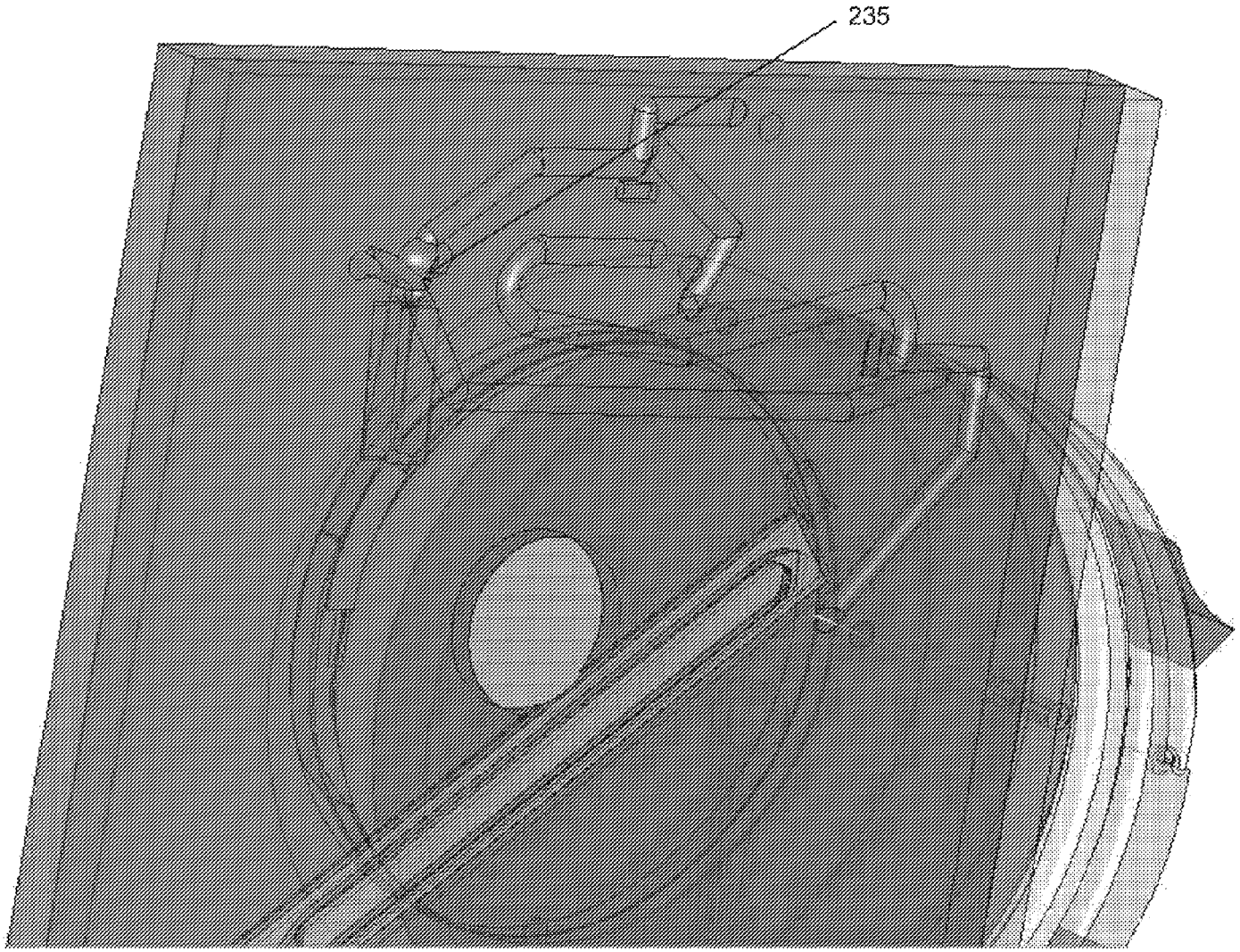
FIG. 33 illustrates the assembly mixer.

FIG. 33: It illustrates the combined CEM Plate S2 (FIG. 14) and CEM Plate S3 (FIG. 15), where the 3D construction of the Mixer (235) may be seen.

FIG. 34: It illustrates the CEM Plate S2 track, a component, constructed of non-caloric energy conducting ceramic. FIG. 34*a*: The back side (240) of the track is precisely constructed to closely fit the rectangular cavity in the CEM Plate S2 (FIG. 14*a*), (54), which is prescribed for this track. The top surface (244) of the track shall rest (246) flush in the surface of plate S2.

Figures 35, 35A, 35B:
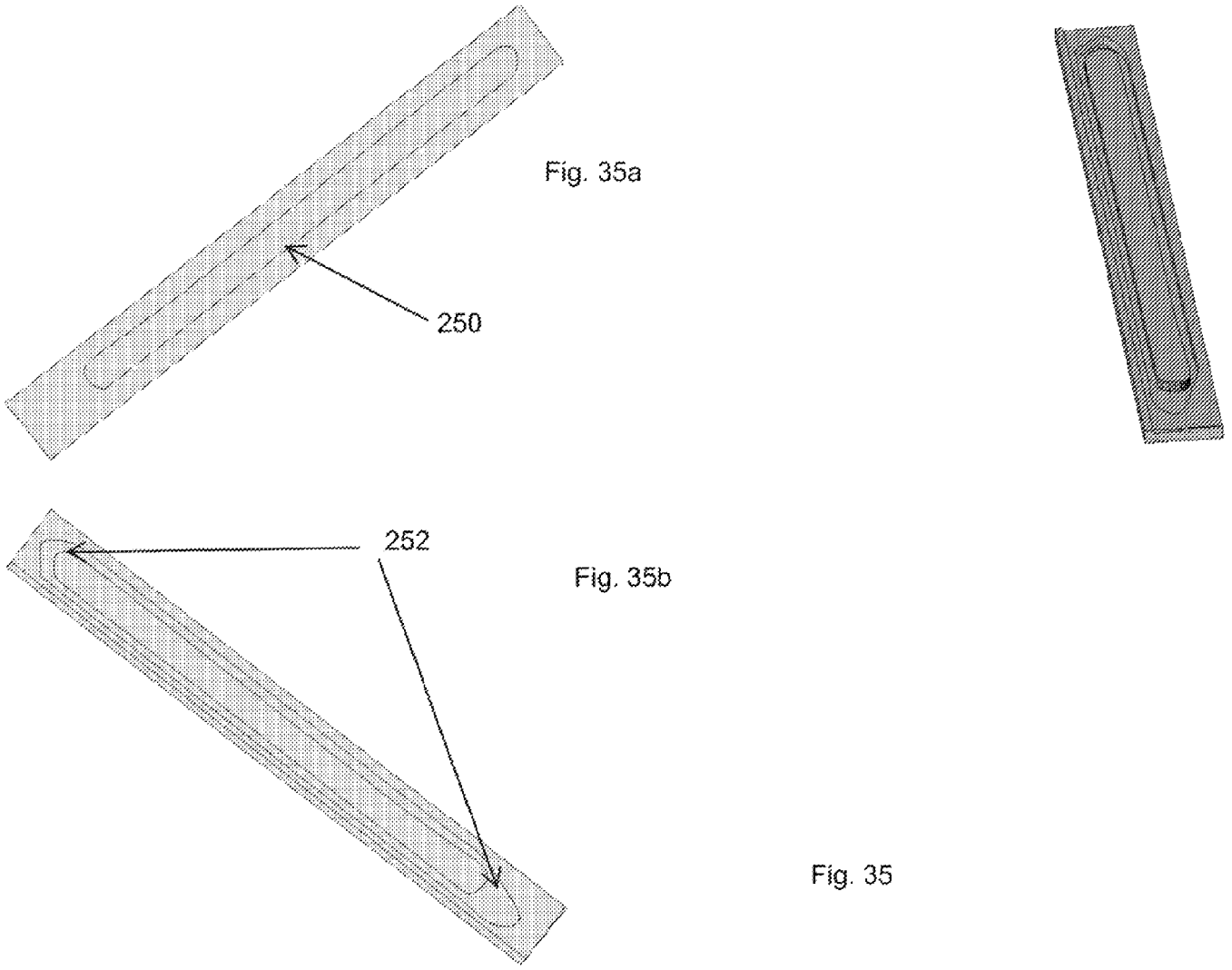
FIGS. 35, 35A, and 35B illustrate various perspectives of the CEM Plate S3 Track.
Figure 37:
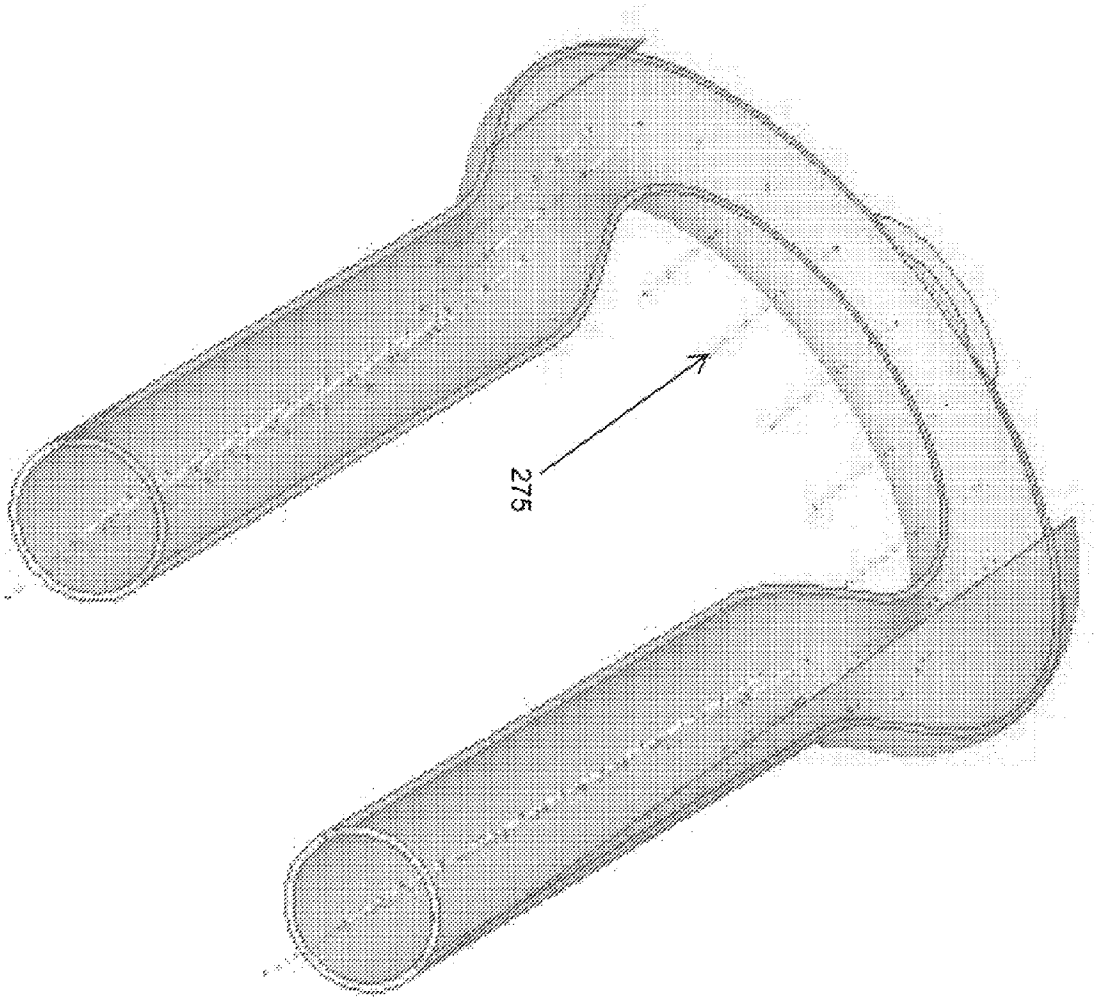
FIG. 37 illustrates the quill employed by intersecting a surface in the cutaway depiction of a Porcupine heat exchanger.

FIG. 35: It illustrates the CEM Plate S3 track, a component, constructed of non-caloric energy conducting ceramic. FIG. 35*a*: The back side (250) of the track is precisely constructed to closely fit the rectangular cavity in the CEM Plate S3 (FIG. 15*a*), (67), which is prescribed for this track. The top surface (252) of the track shall rest flush in the surface of plate S3.

FIG. 36: It illustrates the CEM pump rotor, a component, constructed of non-caloric energy conducting ceramic. FIG. 36*a*: The triangular extrusions (260) are set to accelerate the media that encounters the top of the rotor towards the edge of the pump, as it turns counter-clockwise. The area in the center of the pump rotor (262) is open to decrease the action of vortex for media that enters the center, allowing simple centrifugal force to move the centralized media to the extrusions. FIG. 36*b*: The pump-rotor exhibits a beveled edge (264) to promote the circular sliding, while partially submerged in media, driving the media by this motion to the pump toward the exit chute (FIG. 13*b*), (39), (FIG. 14*a*), (41). FIG. 36*c*: The pump rotor seats into the cavity (FIG. 15*a*), (51), while the serrations on the side of the hub (268) match with the dome spacing of the Shuttle (FIG. 23*a*), (151). The passing motion of the Shuttle (FIG. 23) instigates rotation of the pump-hub counter-clockwise by a few degrees with each pass.

Assembly of the CEM

To assemble the CEM one must first locate the turret of the case. A clean glovebox is necessary. Then place all components into the glove box sealed in their delivery bags. Close the glovebox. Open the bag of square plate parts, then lay them out sequentially on the work-strip with the index notch (FIG. 13*a*), (34) oriented to the index tab (FIG. 6*b*), (4) in the corner of the case. These small parts are necessary and found in one bag: One S3 Track; One S2 Track; One Shuttle; One pump Rotor; two switch Balls; One Bias Magnet; One Lock Magnet; four hot-spots, F1-F4. The case must be placed turret up into a jig, so that the access to the bottom of the case is clear by two or three inches. Beginning with the S1 (FIG. 13) plate, stack the plates' C (FIG. 12), D (FIG. 11), then E (FIG. 10), insuring the holes (FIG. 13*a*), (30-33) align as shown on top of the S1 plate, first the C plate, next the D plate, and finally, the E plate. Once you have all these parts assembled, you may push the arrangement gently into the case until the assembly top butts into the turret all the way to the end of easy travel. Next assemble the S3 (FIG. 15) plate, placing the Bias Magnet (FIG. 15*a*), (68) and Lock Magnet (FIG. 15*a*), (66), and the S3 Track onto the S3 plate surface properly positioned. Place the two switch balls into place. Place the Shuttle (FIG. 23) onto the track in the park position (FIG. 15), (66). Press the S2 Track into place into the lower surface of the S2 plate. Lower the S2 plate onto the S3 plate. Place the pump rotor onto the S2 plate, next push the (S2, S3) arrangement up into the S1 plate inside the case until ease of insertion is resisted. Finally, place the S9A plate into the work area. Place the S8 plate on top of the S9A plate, be sure the index notch is similarly matched on each plate. Next place the S7 plate at the top of the S8 plate, pay attention to the index notch. Then next place the S6 plate on top of the S7 plate. Place the S5 plate on top of the S6 plate and continue ceasing the assembly when the S4 plate is placed on top of the S5 plate. Check to be sure all index notches are on the same corner. Rotate the assembly to match the index notch in the case, then push the arrangement into the case. Finally, if the S9 plate has the electrical cord attached to handle it carefully to keep the cord from getting into the way, apply silicone RTV around all vertical outside edges of the S9 plate. Remove the case from the jig. Place the case assembly turret down into the cavity designed for it. Place the S9 plate into the case allow it to sit five minutes then turn the assembly over. Draw a vacuum in the glovebox. Place the tube fitting over the E plate. Pump media into the unit until 1.3 oz of media has been loaded as indicated by the meter. Remove the tube fitting. Place each hot-spot into its proper alignment (FIG. 25*a*), (165) position, make sure each unit snaps all the way down. At this point, you have a completely assembled and loaded the CEM that is sealed and ready for installation.

Method of Operation

On cold start, the engine control PLC would sense through 1-WIRE™ components the presence of fuel or electric energy. If both are available, the electric activation retains priority. The electric power is switched on to the heat element, then the pump Shuttle inside the space between S2 and S3 commences to cycle around its track channel rotating the pump rotor 7 degrees on each pass. The PLC controls the cycle of the shuttle by activation of an inline Electromagnet is located on the outside of the caloric manager case. Cycling this electromagnet produces slow media movement within the CEM. It could take up to two minutes for the system to reach minimal operating temperature from electrical activation. Once the storage levels heat to the minimal level the control PLC would issue engine start sequence. Alternately, when fuel is the energy source for a cold starting the cycle is somewhat reversed. The PLC would activate an electromagnet to inline with switch B directing pump output to enter the caloric energy inductor loop. The PLC would turn on the fuel valve, then a command to initiate the spark sequence to start combustion. The media circulating around the induction loop would be heated by the Caloric Induction Ring, which conducts caloric energy from the convection and infrared caloric radiation immediately, surrounding its vicinity from fuel that was combusted. This outside caloric energy is absorbed by the ring, whose fingers protrude inside to embed the transfer media with caloric energy. As media travels across the induction loop, some of the media is routed by switch And, when activated by the PLC to go to the mix chamber, where heated media is mixed with media of fewer caloric intensity, this mixed media is directed to the caloric conductor loop by switch B. The switches oscillate between the loops, allowing the heating of the caloric storage area and conducting the hot-spots to occur simultaneously, while the engine runs. Once the caloric storage levels are at a temperature level for sustained operation without caloric energy input by the fuel or electrical activation, the caloric energy source becomes inactive for a period. If there is a significant temperature drop detected at the electronic sensor, the caloric energy source restart sequence begins. On shutting down caloric energy held in the storage is maintained with high integrity for days to months. With that stored energy a quick-start sequence would activate the engine in less than a minute.

The invention claimed is:

1. A caloric energy retention, absorption, and management system comprising:

an open-ended enclosure comprising a turret attached to a box;

a ring-shaped caloric energy transfer device attached to the turret, the energy transfer device configured to impart caloric energy from outside of the box into an energy transport media to increase energy density of said transport media, wherein said transport media is composed of non-hydrogenated cottonseed oil;

a spiral caloric embedding loop formed between two plates (D) and (E), the loop configured to transfer caloric energy to hot spots inserted into plate (E), wherein said hot spots have quills along an inner surface of matching spiral grooves to enhance energy transfer;

a magnetically-controlled reciprocating drive member configured to impart rotary motion to a pump;

a caloric energy storage device comprising five square plates, (S4), (S5), (S6), (S7), and (S8), the energy storage device forming three sets of spiral tubes between adjacent joined plate pairs, wherein the three sets of spiral tubes are connected with entry and exit cavities to form a continuous spiral path, wherein said plate (S8) of the energy storage device comprises quills along the spiral tube inner surface which cause the energy transport media to eddy and increase thermal transfer, and wherein the spiral tubes are thermally isolated from the outside of the box;

a caloric energy embedding sandwich thermally connected to the caloric energy storage device, the caloric energy embedding sandwich comprising two additional square plates, (S9) and (S9A), and an electric heating element, wherein said plate (S9A) is composed of a thermally conductive material and said plate (S9) is composed of a material with less thermal conductivity than the material of plate (S9A), the caloric energy embedding sandwich configured to direct caloric energy towards said plate (S8);

a magnetically-controlled ball valve controlling the flow of the caloric energy transport media, wherein the ball is composed of a ceramic material with a ferrite core responsive to magnetic forces; and wherein plates (S4), (S5), (S6), (S7), (S8), (S9), and (S9A) are located within the box.

2. The caloric energy system according to claim 1, wherein the ring-shaped caloric energy transfer device comprises quills to enhance thermal transfer.

3. The caloric energy system according to claim 1, wherein the spiral grooves form tubes comprising quills along their inner surface to enhance thermal transfer.

* * * * *